US008613818B2

(12) United States Patent
Forbes Jones et al.

(10) Patent No.: US 8,613,818 B2
(45) Date of Patent: Dec. 24, 2013

(54) PROCESSING ROUTES FOR TITANIUM AND TITANIUM ALLOYS

(75) Inventors: Robin M. Forbes Jones, Charlotte, NC (US); John V. Mantione, Indian Trail, NC (US); Urban J. De Souza, Ann Arbor, MI (US); Jean-Philippe Thomas, Charlotte, NC (US); Ramesh S. Minisandram, Charlotte, NC (US); Richard L. Kennedy, Monroe, NC (US); R. Mark Davis, Marshville, NC (US)

(73) Assignee: ATI Properties, Inc., Albany, OR (US)

( * ) Notice: Subject to any disclaimer, the term of this patent is extended or adjusted under 35 U.S.C. 154(b) by 505 days.

(21) Appl. No.: 12/882,538

(22) Filed: Sep. 15, 2010

(65) Prior Publication Data

US 2012/0060981 A1 Mar. 15, 2012

(51) Int. Cl.
*C21D 8/00* (2006.01)
*C22F 1/00* (2006.01)

(52) U.S. Cl.
USPC ..... 148/649; 148/672; 148/692; 148/670

(58) Field of Classification Search
USPC ..... 148/649, 672, 692, 670
See application file for complete search history.

(56) References Cited

U.S. PATENT DOCUMENTS

| | | | | |
|---|---|---|---|---|
| 5,141,566 | A * | 8/1992 | Kitayama et al. | 148/670 |
| 5,600,989 | A | 2/1997 | Segal et al. | |
| 6,197,129 | B1 | 3/2001 | Zhu et al. | |
| 6,209,379 | B1 | 4/2001 | Nishida et al. | |
| 6,399,215 | B1 | 6/2002 | Zhu et al. | |
| 6,569,270 | B2 | 5/2003 | Segal | |
| 2002/0153071 | A1 | 10/2002 | Segal et al. | |
| 2005/0145310 | A1 | 7/2005 | Bewlay et al. | |
| 2007/0193018 | A1 * | 8/2007 | Davis et al. | 29/527.7 |

FOREIGN PATENT DOCUMENTS

| | | |
|---|---|---|
| WO | WO 98/17836 | 4/1998 |
| WO | WO 02/36847 A2 | 5/2002 |

OTHER PUBLICATIONS

Imayev et al,, "Principles of Fabrication of Bulk Ultrafine-Grained and Nanostructured Materials by Multiple Isothermal Forging", Materials Science Forum, vols. 638-642, 2010, 7 pages.

Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.

(Continued)

*Primary Examiner* — Rebecca Lee

(74) *Attorney, Agent, or Firm* — K & L Gates LLP; Patrick J. Viccaro; John E. Grosselin, III

(57) ABSTRACT

Methods of refining the grain size of titanium and titanium alloys include thermally managed high strain rate multi-axis forging. A high strain rate adiabatically heats an internal region of the workpiece during forging, and a thermal management system is used to heat an external surface region to the workpiece forging temperature, while the internal region is allowed to cool to the workpiece forging temperature. A further method includes multiple upset and draw forging titanium or a titanium alloy using a strain rate less than is used in conventional open die forging of titanium and titanium alloys. Incremental workpiece rotation and draw forging causes severe plastic deformation and grain refinement in the titanium or titanium alloy forging.

25 Claims, 20 Drawing Sheets

(56) References Cited

OTHER PUBLICATIONS

Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Salishchev et al., "Mechanical Properties of Ti-6Al-4V Titanium Alloy with Submicrocrystalline Structure Produced by Multiaxial Forging", Materials Science Forum, vols. 584-586, 2008, pp. 783-788.
Imayev et al., "Formation of submicrocrystalline structure in TiAl intermetallic compound", Journal of Materials Science, 27, 1992, pp. 4465-4471.
Zherebtsov et al., "Production of submicrocrystalline structure in large-scale Ti-6Al-4V billet by warm severe deformation processing", Scripta Materialia, 51, 2004, pp. 1147-1151.
Bewlay, et al., "Superplastic roll forming of Ti alloys", Materials and Design, 21, 2000, pp. 287-295.
DiDomizio, et al., "Evaluation of a Ni-20Cr Alloy Processed by Multi-axis Forging", Materials Science Forum vols. 503-504, 2006, pp. 793-798.
Gigliotti et al., "Evaluation of Superplastically Roll Formed VT-25", Titamium'99, Science and Technology, 2000, pp. 1581-1588.
Marte et al., "Structure and Properties of NI-20CR Produced by Severe Plastic Deformation", Ultrafine Grained Materials IV, 2006, pp. 419-424.
Desrayaud et al., "A novel high straining process for bulk materials—The development of a multipass forging system by compression along three axes", Journal of Materials Processing Technology, 172, 2006, pp. 152-158.
Salishchev et al., "Characterization of Submicron-grained Ti-6Al-4V Sheets with Enhanced Superplastic Properties", Materials Science Forum, Trans Tech Publications, Switzerland, vols. 447-448, 2004, pp. 441-446.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
Isothermal forging definition, ASM Materials Engineering Dictionary, J.R. Davis ed., Fifth Printing, Jan. 2006, ASM International, p. 238.
Adiabatic definition, ASM Materials Engineering Dictionary. J.R. Davis ed., Fifth Printing, Jan. 2006, ASM International, p. 9.
Adiabatic process—Wikipedia, the free encyclopedia, printed from http://en.wikipedia.org/wiki/Adiabatic_process, accessed May 21, 2013, 10 pages.
Isothermal forging, printed from http://thelibraryofmanufacturing.com/isothermal_forging.html, accessed Jun. 5, 2013, 3 pages.

* cited by examiner 20
28

A
24
30
38
36
50
32

38
46
42

44
B
48
42
40

50
40
56

C
58
50
33

PROCESSING ROUTES FOR TITANIUM AND TITANIUM ALLOYS

STATEMENT REGARDING FEDERALLY SPONSORED RESEARCH OR DEVELOPMENT

This invention was made with United States government support under NIST Contract Number 70NANB7H7038, awarded by the National Institute of Standards and Technology (NIST), United States Department of Commerce. The United States government may have certain rights in the invention.

BACKGROUND OF THE TECHNOLOGY

1. Field of the Technology

The present disclosure is directed to forging methods for titanium and titanium alloys and to apparatus for conducting such methods.

2. Description of the Background of the Technology

Methods for producing titanium and titanium alloys having coarse grain (CG), fine grain (FG), very fine grain (VFG), or ultrafine grain (UFG) microstructure involve the use of multiple reheats and forging steps. Forging steps may include one or more upset forging steps in addition to draw forging on an open die press.

As used herein, when referring to titanium and titanium alloy microstructure: the term "coarse grain" refers to alpha grain sizes of 400 μm to greater than about 14 μm; the term "fine grain" refers to alpha grain sizes in the range of 14 μm to greater than 10 μm; the term "very fine grain" refers to alpha grain sizes of 10 μm to greater than 4.0 μm; and the term "ultra fine grain" refers to alpha grain sizes of 4.0 μm or less.

Known commercial methods of forging titanium and titanium alloys to produce coarse (CG) or fine grain (FG) microstructures employ strain rates of 0.03 $s^{-1}$ to 0.10 $s^{-1}$ using multiple reheats and forging steps.

Known methods intended for the manufacture of fine (FG), very fine (VFG) or ultra fine grain (UFG) microstructures apply a multi-axis forging (MAF) process at an ultra-slow strain rate of 0.001 $s^{-1}$ or slower (see G. Salishchev, et. al., *Materials Science Forum*, Vol. 584-586, pp. 783-788 (2008)). The generic MAF process is described in C. Desrayaud, et. al, *Journal of Materials Processing Technology,* 172, pp. 152-156 (2006).

The key to grain refinement in the ultra-slow strain rate MAF process is the ability to continually operate in a regime of dynamic recrystallization that is a result of the ultra-slow strain rates used, i.e., 0.001 $s^{-1}$ or slower. During dynamic recrystallization, grains simultaneously nucleate, grow, and accumulate dislocations. The generation of dislocations within the newly nucleated grains continually reduces the driving force for grain growth, and grain nucleation is energetically favorable. The ultra-slow strain rate MAF process uses dynamic recrystallization to continually recrystallize grains during the forging process.

Relatively uniform, cubes of UFG Ti-6-4 alloy can be produced using the ultra-slow strain rate MAF process, but the cumulative time taken to perform the MAF can be excessive in a commercial setting. In addition, conventional large scale, commercially available open die press forging equipment may not have the capability to achieve the ultra-slow strain rates required in such embodiments and, therefore, custom forging equipment may be required for production-scale ultra-slow strain rate MAF.

Accordingly, it would be advantageous to develop a process for producing titanium and titanium alloys having coarse, fine, very fine or ultrafine grain microstructure that does not require multiple reheats and/or accommodates higher strain rates, reduces the time necessary for processing, and eliminates the need for custom forging equipment.

SUMMARY

According to an aspect of the present disclosure, a method of refining the grain size of a workpiece comprising a metallic material selected from titanium and a titanium alloy comprises heating the workpiece to a workpiece forging temperature within an alpha+beta phase field of the metallic. The workpiece is then multi-axis forged. Multi-axis forging comprises press forging the workpiece at the workpiece forging temperature in the direction of a first orthogonal axis of the workpiece with a strain rate sufficient to adiabatically heat an internal region of the workpiece. Forging in the direction of the first orthogonal axis is followed by allowing the adiabatically heated internal region of the workpiece to cool to the workpiece forging temperature, while heating an outer surface region of the workpiece to the workpiece forging temperature. The workpiece is then press-forged at the workpiece forging temperature in the direction of a second orthogonal axis of the workpiece with a strain rate that is sufficient to adiabatically heat the internal region of the workpiece. Forging in the direction of the second orthogonal axis is followed by allowing the adiabatically heated internal region of the workpiece to cool to the workpiece forging temperature, while heating an outer surface region of the workpiece to the workpiece forging temperature. The workpiece is then press-forged at the workpiece forging temperature in the direction of a third orthogonal axis of the workpiece with a strain rate that is sufficient to adiabatically heat the internal region of the workpiece. Forging in the direction of the third orthogonal axis is followed by allowing the adiabatically heated internal region of the workpiece to cool to the workpiece forging temperature, while heating an outer surface region of the workpiece to the workpiece forging temperature. The press forging and allowing steps are repeated until a strain of at least 3.5 is achieved in at least a region of the titanium alloy workpiece. In a non-limiting embodiment, a strain rate used during press forging is in the range of 0.2 $s^{-1}$ to 0.8 $s^{-1}$, inclusive.

According to another aspect of the present disclosure, a method of refining grain size of a workpiece comprising a metallic material selected from titanium and titanium alloy comprises heating the workpiece to a workpiece forging temperature within an alpha+beta phase field of the metallic material. In non-limiting embodiments, the workpiece comprises a cylindrical-like shape and a starting cross-sectional dimension. The workpiece is upset forged at the workpiece forging temperature. After upsetting, the workpiece is multiple pass draw forged at the workpiece forging temperature. Multiple pass draw forging comprises incrementally rotating the workpiece in a rotational direction followed by draw forging the workpiece after each rotation. Incrementally rotating and draw forging the workpiece is repeated until the workpiece comprises substantially the same starting cross-sectional dimension of the workpiece. In a non-limiting embodiment, a strain rate used in upset forging and draw forging is the range of 0.001 $s^{-1}$ to 0.02 $s^{-1}$, inclusive.

According to an additional aspect of the present disclosure, a method for isothermal multi-step forging of a workpiece comprising a metallic material selected from a metal and a metal alloy comprises heating the workpiece to a workpiece forging temperature. The workpiece is forged at the workpiece forging temperature at a strain rate sufficient to adiabatically heat an internal region of the workpiece. The internal region of the workpiece is allowed to cool to the workpiece forging temperature, while an outer surface region of the workpiece is heated to the workpiece forging temperature. The steps of forging the workpiece and allowing the internal region of the workpiece to cool while heating the outer surface region of the metal alloy are repeated until a desired characteristic is obtained.

BRIEF DESCRIPTION OF THE DRAWINGS

The features and advantages of apparatus and methods described herein may be better understood by reference to the accompanying drawings in which:

FIG. 16(*b*) is a cross-section from the near surface of the sample processed according to Example 7;

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain by way of the methods according to the present disclosure. At the very least, and not as an attempt to limit the application of the doctrine of equivalents to the scope of the claims, each numerical parameter should at least be construed in light of the number of reported significant digits and by applying ordinary rounding techniques.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

An aspect of this disclosure includes non-limiting embodiments of a multi-axis forging process that includes using high strain rates during the forging steps to refine grain size in titanium and titanium alloys. These method embodiments are generally referred to in this disclosure as "high strain rate multi-axis forging" or "high strain rate MAF".

Figure 1:
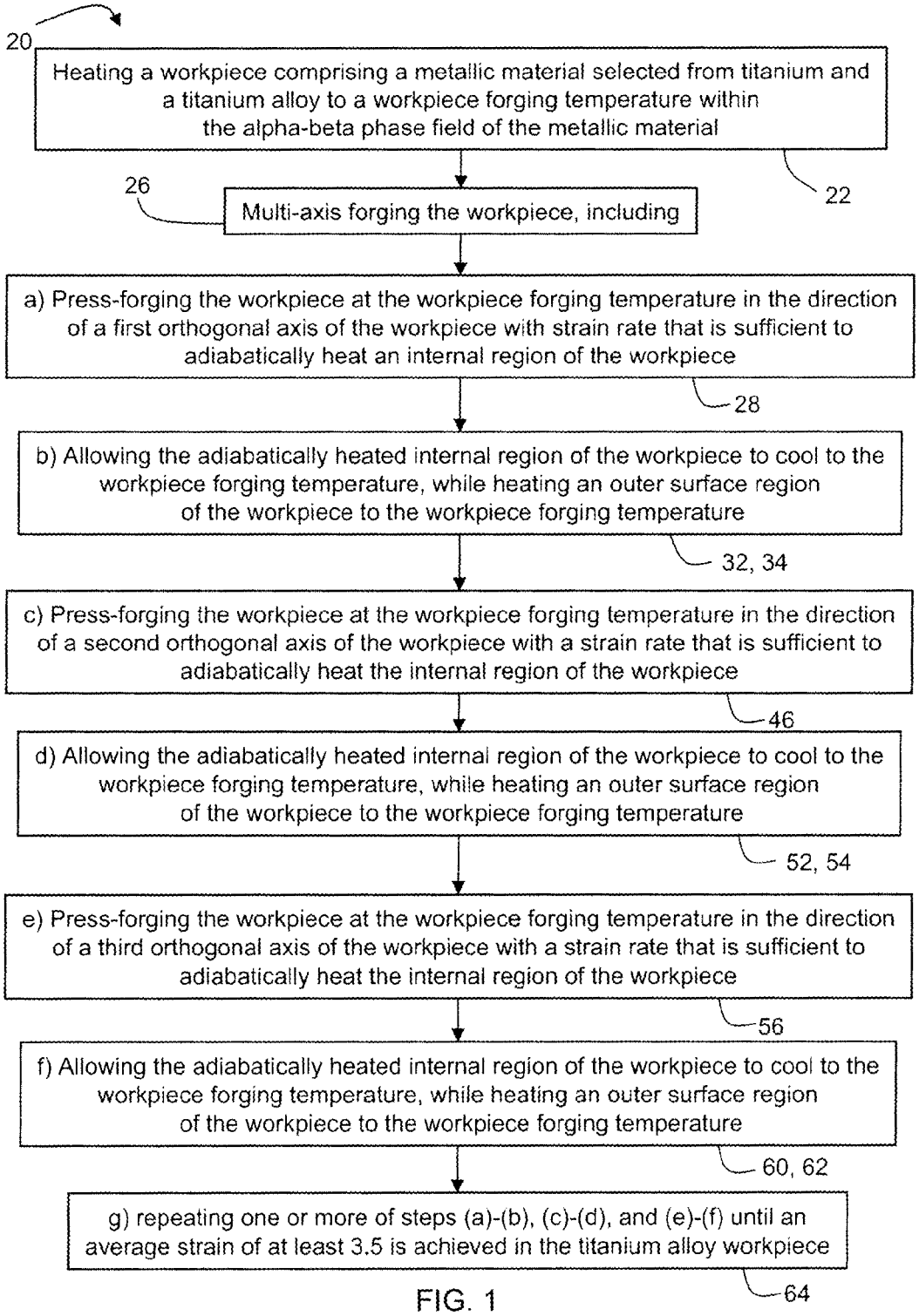
FIG. 1 is a flow chart listing steps of a non-limiting embodiment of a method according to the present disclosure for processing titanium and titanium alloys for grain size refinement.
Figures 2A, 2B, 2C, 2D, 2E, 2F:
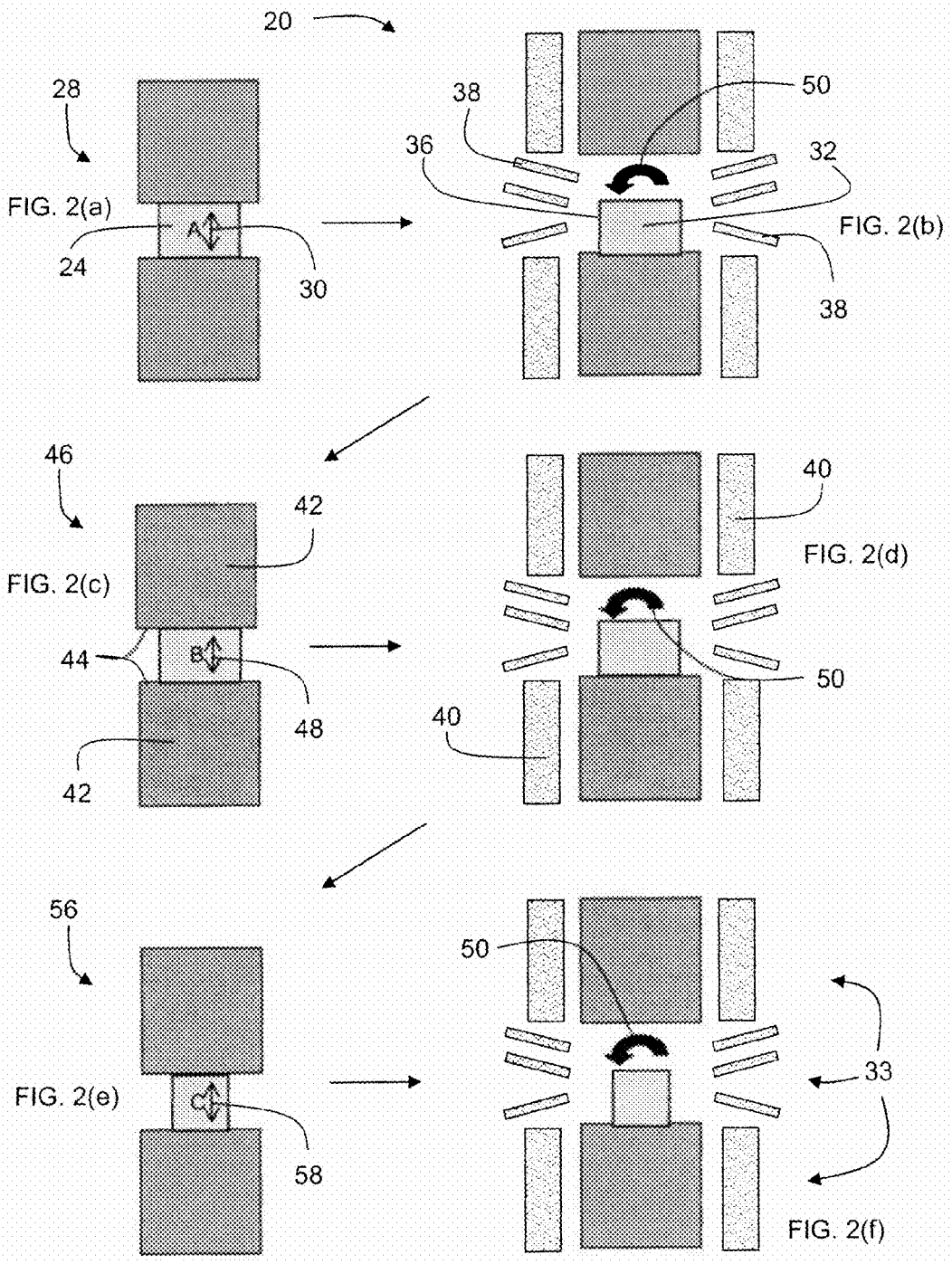
FIG. 2 is a schematic representation of a non-limiting embodiment of a high strain rate multi-axis forging method using thermal management for processing titanium and titanium alloys for the refinement of grain sizes, wherein FIGS. 2(*a*), 2(*c*), and 2(*e*) represent non-limiting press forging steps, and FIGS. 2(*b*), 2(*d*), and 2(*f*) represent non-limiting cooling and heating steps according to non-limiting aspects of this disclosure.

Referring now to the flow chart in FIG. 1 and the schematic representation in FIG. 2, in a non-limiting embodiment according to the present disclosure, a method 20 of using a high strain rate multi-axis forging (MAF) process for refining the grain size of titanium or titanium alloys is depicted. Multi-axis forging (26), also known as "a-b-c" forging, which is a form of severe plastic deformation, includes heating (step 22 in FIG. 1) a workpiece comprising a metallic material selected from titanium and a titanium alloy 24 to a workpiece forging temperature within an alpha+beta phase field of the metallic material, followed by MAF 26 using a high strain rate.

As will be apparent from a consideration of the present disclosure, a high strain rate is used in high strain rate MAF to adiabatically heat an internal region of the workpiece. However, in a non-limiting embodiment according to this disclosure, in at least the last sequence of a-b-c hits of high strain rate MAF, the temperature of the internal region of the titanium or titanium alloy workpiece 24 should not exceed the beta-transus temperature ($T_\beta$) of the titanium or titanium alloy workpiece. Therefore, the workpiece forging temperature for at least the final a-b-c- sequence of high strain rate MAF hits should be chosen to ensure that the temperature of the internal region of the workpiece during high strain rate MAF does not equal or exceed the beta-transus temperature of the metallic material. In a non-limiting embodiment according to this disclosure, the internal region temperature of the workpiece does not exceed 20° F. (11.1° C.) below the beta transus temperature of the metallic material, i.e., $T_\beta$-20° F. ($T_\beta$-11.1° C.), during at least the final high strain rate sequence of a-b-c MAF hits.

In a non-limiting embodiment of high strain rate MAF according to this disclosure, a workpiece forging temperature comprises a temperature within a workpiece forging temperature range. In a non-limiting embodiment, the workpiece forging temperature is in a workpiece forging temperature range of 100° F. (55.6° C.) below the beta transus temperature ($T_\beta$) of titanium or titanium alloy metallic material to 700° F. (388.9° C.) below the beta transus temperature of the titanium or titanium alloy metallic material. In still another non-limiting embodiment, the workpiece forging temperature is in a temperature range of 300° F. (1661° C.) below the beta transition temperature of titanium or the titanium alloy to 625° F. (347° C.) below the beta transition temperature of the titanium or titanium alloy. In a non-limiting embodiment, the low end of a workpiece forging temperature range is a temperature in the alpha+beta phase field wherein substantial damage does not occur to the surface of the workpiece during the forging hit, as would be known to a person having ordinary skill in the art.

In a non-limiting embodiment, the workpiece forging temperature range when applying the embodiment of the present disclosure of FIG. 1 to a Ti-6-4 alloy (Ti-6Al-4V; UNS No. R56400), which has a beta transus temperature ($T_\beta$) of about 1850° F. (1010° C.), may be from 1150° F. (621.1° C.) to 1750° F. (954.4° C.), or in another embodiment may be from 1225° F. (662.8° C.) to 1550° F. (843.3° C.).

In a non-limiting embodiment, prior to heating 22 the titanium or titanium alloy workpiece 24 to a workpiece forging temperature within the alpha+beta phase field, the workpiece 24 optionally is beta annealed and air cooled (not shown). Beta annealing comprises heating the workpiece 24 above the beta transus temperature of the titanium or titanium alloy metallic material and holding for a time sufficient to form all beta phase in the workpiece. Beta annealing is a well know process and, therefore, is not described in further detail herein. A non-limiting embodiment of beta annealing may include heating the workpiece 24 to a beta soaking temperature of about 50° F. (27.8° C.) above the beta transus temperature of the titanium or titanium alloy and holding the workpiece 24 at the temperature for about 1 hour.

Referring again to FIGS. 1 and 2, when the workpiece comprising a metallic material selected from titanium and a titanium alloy 24 is at the workpiece forging temperature, the workpiece is subjected to high strain rate MAF (26). In a non-limiting embodiment according to this disclosure, MAF 26 comprises press forging (step 28, and shown in FIG. 2(*a*)) the workpiece 24 at the workpiece forging temperature in the direction (A) of a first orthogonal axis 30 of the workpiece using a strain rate that is sufficient to adiabatically heat the workpiece, or at least adiabatically heat an internal region of the workpiece, and plastically deform the workpiece 24. In non-limiting embodiments of this disclosure, the phrase "internal region" as used herein refers to an internal region including a volume of about 20%, or about 30%, or about 40%, or about 50% of the volume of the cube.

High strain rates and fast ram speeds are used to adiabatically heat the internal region of the workpiece in non-limiting embodiments of high strain rate MAF according to this disclosure. In a non-limiting embodiment according to this disclosure, the term "high strain rate" refers to a strain rate range of about 0.2 $s^{-1}$ to about 0.8 $s^{-1}$, inclusive. In another non-limiting embodiment according to this disclosure, the term "high strain rate" as used herein refers to a strain rate of about 0.2 $s^{-1}$ to about 0.4 $s^{-1}$, inclusive.

In a non-limiting embodiment according to this disclosure, using a high strain rate as defined hereinabove, the internal region of the titanium or titanium alloy workpiece may be adiabatically heated to about 200° F. above the workpiece forging temperature. In another non-limiting embodiment, during press forging the internal region is adiabatically heated to about 100° F. (55.6° C.) to 300° F. (166.7° C.) above the workpiece forging temperature. In still another non-limiting embodiment, during press forging the internal region is adiabatically heated to about 150° F. (83.3° C.) to 250° F. (138.9° C.) above the workpiece forging temperature. As noted above, no portion of the workpiece should be heated above the beta-transus temperature of the titanium or titanium alloy during the last sequence of high strain rate a-b-c MAF hits.

In a non-limiting embodiment, during press forging (28) the workpiece 24 is plastically deformed to a 20% to 50% reduction in height or another dimension. In another non-limiting embodiment, during press forging (28) the titanium alloy workpiece 24 is plastically deformed to a 30% to 40% reduction in height or another dimension.

Figure 3:
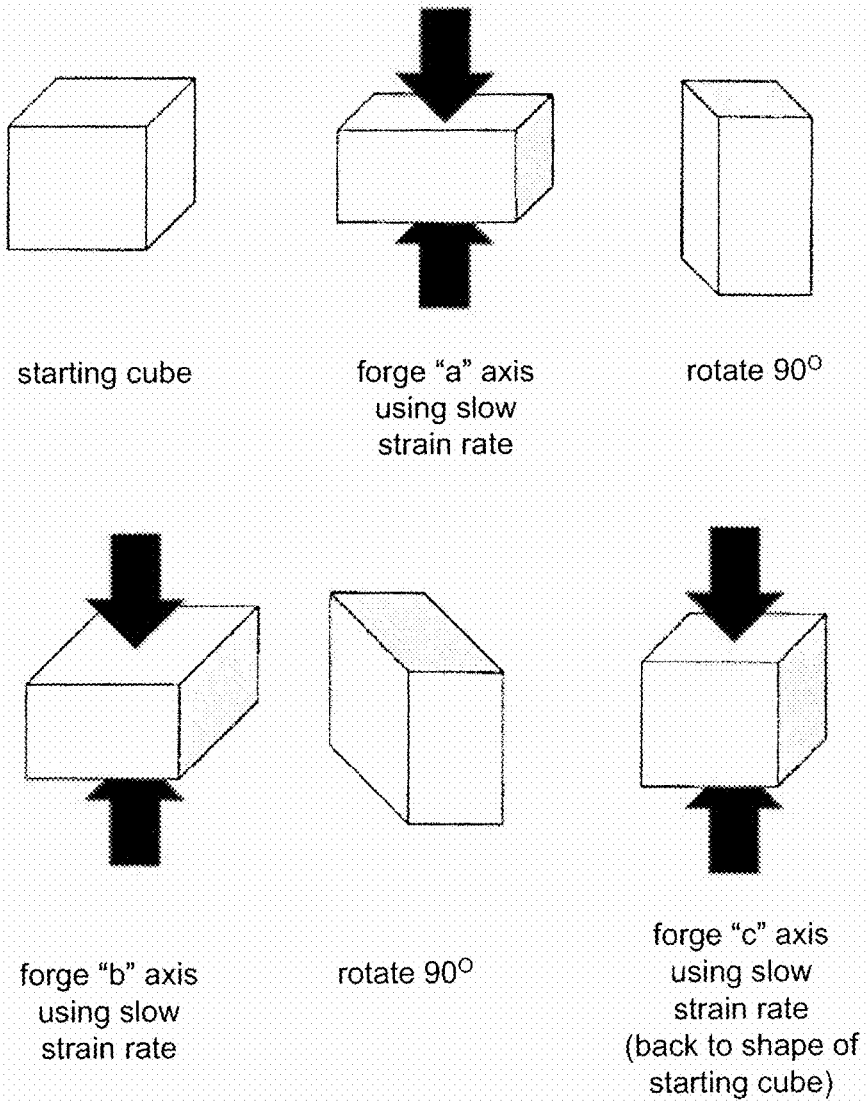
FIG. 3 PRIOR ART
FIG. 3 is a schematic representation of a slow strain rate multi-axis forging technique known to be used to refine grains of small scale samples.

A known slow strain rate multi-axis forging process is depicted schematically in FIG. 3. Generally, an aspect of multi-axis forging is that after every three strokes or "hits" of the forging apparatus, such as an open die forge, the shape of the workpiece approaches that of the workpiece just prior to the first hit. For example, after a 5-inch sided cubic workpiece is initially forged with a first "hit" in the direction of the "a" axis, rotated 90° and forged with a second hit in the direction of the "b" axis, and rotated 90° and forged with a third hit in the direction of the "c" axis, the workpiece will resemble the starting cube with 5-inch sides.

In another non-limiting embodiment, a first press forging step 28, shown in FIG. 2(*a*), also referred to herein as the "first hit", may include press forging the workpiece on a top face down to a predetermined spacer height while the workpiece is at a workpiece forging temperature. A predetermined spacer height of a non-limiting embodiment is, for example, 5 inches. Other spacer heights, such as, for example, less than 5 inches, about 3 inches, greater than 5 inches, or 5 inches up to 30 inches are within the scope of embodiments herein, but should not be considered as limiting the scope of the present disclosure. Larger spacer heights are only limited by the capabilities of the forge and, as will be seen herein, the capabilities of the thermal management system according to the present disclosure. Spacer heights of less than 3 inches are also within the scope of the embodiments disclosed herein, and such relatively small spacer heights are only limited by the desired characteristics of a finished product and, possibly, any prohibitive economics that may apply to employing the present method on workpieces having relatively small sizes. The use of spacers of about 30 inches, for example, provides the ability to prepare billet-sized 30-inch sided cubes with fine grain size, very fine grain size, or ultrafine grain size. Billet-sized cubic forms of conventional alloys have been employed in forging houses for manufacturing disk, ring, and case parts for aeronautical or land-based turbines.

After press forging 28 the workpiece 24 in the direction of the first orthogonal axis 30, i.e., in the A-direction shown in FIG. 2(*a*), a non-limiting embodiment of a method according to the present disclosure further comprises allowing (step 32) the temperature of the adiabatically heated internal region (not shown) of the workpiece to cool to the workpiece forging temperature, which is shown in FIG. 2(*b*). Internal region cooling times, or waiting times, may range, for example in non-limiting embodiments, from 5 seconds to 120 seconds, from 10 seconds to 60 seconds, or from 5 seconds to 5 minutes. It will be recognized by a person skilled in the art that internal region cooling times required to cool the internal region to the workpiece forging temperature will be dependent on the size, shape, and composition of the workpiece 24, as well as the conditions of the atmosphere surrounding the workpiece 24.

During the internal region cooling time period, an aspect of a thermal management system 33 according to non-limiting embodiments disclosed herein comprises heating (step 34) an outer surface region 36 of the workpiece 24 to a temperature at or near the workpiece forging temperature. In this manner, the temperature of the workpiece 24 is maintained in a uniform or near uniform and substantially isothermal condition at or near the workpiece forging temperature prior to each high strain rate MAF hit. In non-limiting embodiments, using the thermal management system 33 to heat the outer surface region 36, together with the allowing the adiabatically heated internal region to cool for a specified internal region cooling time, the temperature of the workpiece returns to a substantially uniform temperature at or near the workpiece forging temperature between each a-b-c forging hit. In another non-limiting embodiment according to this disclosure, using the thermal management system 33 to heat the outer surface region 36, together with allowing the adiabatically heated internal region to cool for a specified internal region cooling time, the temperature of the workpiece returns to a substantially uniform temperature within the workpiece forging temperature range between each a-b-c forging hit. By utilizing a thermal management system 33 to heat the outer surface region of the workpiece to the workpiece forging temperature, together with allowing the adiabatically heated internal region to cool to the workpiece forging temperature, a non-limiting embodiment according to this disclosure may be referred to as "thermally managed, high strain rate multi-axis forging" or for purposes herein, simply as "high strain rate multi-axis forging".

In non-limiting embodiments according to this disclosure, the phrase "outer surface region" refers to a volume of about 50%, or about 60%, or about 70%, or about 80% of the cube, in the outer region of the cube.

In a non-limiting embodiment, heating 34 an outer surface region 36 of the workpiece 24 may be accomplished using one or more outer surface heating mechanisms 38 of the thermal management system 33. Examples of possible outer surface heating mechanisms 38 include, but are not limited to, flame heaters for flame heating; induction heaters for induction heating; and radiant heaters for radiant heating of the workpiece 24. Other mechanisms and techniques for heating an outer surface region of the workpiece will be apparent to those having ordinary skill upon considering the present disclosure, and such mechanisms and techniques are within the scope of the present disclosure. A non-limiting embodiment of an outer surface region heating mechanism 38 may comprise a box furnace (not shown). A box furnace may be configured with various heating mechanisms to heat the outer surface region of the workpiece using one or more of flame heating mechanisms, radiant heating mechanisms, induction heating mechanisms, and/or any other suitable heating mechanism known now or hereafter to a person having ordinary skill in the art.

In another non-limiting embodiment, the temperature of the outer surface region 36 of the workpiece 24 may be heated 34 and maintained at or near the workpiece forging temperature and within the workpiece forging temperature range using one or more die heaters 40 of a thermal management system 33. Die heaters 40 may be used to maintain the dies 42 or the die press forging surfaces 44 of the dies at or near the workpiece forging temperature or at temperatures within the workpiece temperature forging range. In a non-limiting embodiment, the dies 42 of the thermal management system are heated to a temperature within a range that includes the workpiece forging temperature up to 100° F. (55.6° C.) below the workpiece forging temperature. Die heaters 40 may heat the dies 42 or the die press forging surface 44 by any suitable heating mechanism known now or hereinafter by a person skilled in the art, including, but not limited to, flame heating mechanisms, radiant heating mechanisms, conduction heating mechanisms, and/or induction heating mechanisms. In a non-limiting embodiment, a die heater 40 may be a component of a box furnace (not shown). While the thermal management system 33 is shown in place and being used during the cooling steps 32,52,60 of the multi-axis forging process 26 shown in FIGS. 2(*b*), (*d*), and (*f*), it is recognized that the thermal management system 33 may or may not be in place during the press forging steps 28,46,56 depicted in FIGS. 2(*a*), (*c*), and (*e*).

As shown in FIG. 2(*c*), an aspect of a non-limiting embodiment of a multi-axis forging method 26 according to the present disclosure comprises press forging (step 46) the workpiece 24 at the workpiece forging temperature in the direction (B) of a second orthogonal axis 48 of the workpiece 24 using a strain rate that is sufficient to adiabatically heat the workpiece 24, or at least an internal region of the workpiece, and plastically deform the workpiece 24. In a non-limiting embodiment, during press forging (46), the workpiece 24 is deformed to a plastic deformation of a 20% to 50% reduction in height or another dimension. In another non-limiting embodiment, during press forging (46) the workpiece 24 is plastically deformed to a plastic deformation of a 30% to 40% reduction in height or another dimension. In a non-limiting embodiment, the workpiece 24 may be press forged (46) in the direction of the second orthogonal axis 48 to the same spacer height used in the first press forging step (28). In another non-limiting embodiment according to the disclosure, the internal region (not shown) of the workpiece 24 is adiabatically heated during the press forging step (46) to the same temperature as in the first press forging step (28). In other non-limiting embodiments, the high strain rates used for press forging (46) are in the same strain rate ranges as disclosed for the first press forging step (28).

In a non-limiting embodiment, as shown by arrow 50 in FIGS. 2(*b*) and (*d*), the workpiece 24 may be rotated 50 to a different orthogonal axis between successive press forging steps (e.g., 28,46). This rotation may be referred to as "a-b-c" rotation. It is understood that by using different forge configurations, it may be possible to rotate the ram on the forge instead of rotating the workpiece 24, or a forge may be equipped with multi-axis rams so that rotation of neither the workpiece nor the forge is required. Obviously, the important aspect is the relative movement of the ram and the workpiece, and that rotating 50 the workpiece 24 may be an optional step. In most current industrial equipment set-ups, however, rotating 50 the workpiece to a different orthogonal axis in between press forging steps will be required to complete the multi-axis forging process 26.

In non-limiting embodiments in which a-b-c rotation 50 is required, the workpiece 24 may be rotated manually by a forge operator or by an automatic rotation system (not shown) to provide a-b-c rotation 50. An automatic a-b-c rotation system may include, but is not limited to including, free-swinging clamp-style manipulator tooling or the like to enable a non-limiting thermally managed high strain rate multi-axis forging embodiment disclosed herein.

After press forging 46 the workpiece 24 in the direction of the second orthogonal axis 48, i.e., in the B-direction, and as shown in FIG. 2(*d*), process 20 further comprises allowing (step 52) an adiabatically heated internal region (not shown) of the workpiece to cool to the workpiece forging temperature, which is shown in FIG. 2(*d*). Internal region cooling times, or waiting times, may range, for example, in non-limiting embodiments, from 5 seconds to 120 seconds, or from 10 seconds to 60 seconds, or 5 seconds up to 5 minutes, and it is recognized by a person skilled in the art that the minimum cooling times are dependent upon the size, shape, and composition of the workpiece 24, as well as the characteristics of the environment surrounding the workpiece.

During the internal region cooling time period, an aspect of a thermal management system 33 according to certain non-limiting embodiments disclosed herein comprises heating (step 54) an outer surface region 36 of the workpiece 24 to a temperature at or near the workpiece forging temperature. In this manner, the temperature of the workpiece 24 is maintained in a uniform or near uniform and substantially isothermal condition at or near the workpiece forging temperature prior to each high strain rate MAF hit. In non-limiting embodiments, when using the thermal management system 33 to heat the outer surface region 36, together with allowing the adiabatically heated internal region to cool for a specified internal region cooling time, the temperature of the workpiece returns to a substantially uniform temperature at or near the workpiece forging temperature between each a-b-c forging hits. In another non-limiting embodiment according to this disclosure, when using the thermal management system 33 to heat the outer surface region 36, together with allowing the adiabatically heated internal region to cool for a specified internal region cooling holding time, the temperature of the workpiece returns to a substantially uniform temperature within the workpiece forging temperature range prior to each high strain rate MAF hit.

In a non-limiting embodiment, heating 54 an outer surface region 36 of the workpiece 24 may be accomplished using one or more outer surface heating mechanisms 38 of the thermal management system 33. Examples of possible heating mechanisms 38 may include, but are not limited to, flame heaters for flame heating; induction heaters for induction heating; and/or radiant heaters for radiant heating of the workpiece 24. A non-limiting embodiment of a surface heating mechanism 38 may comprise a box furnace (not shown). Other mechanisms and techniques for heating an outer surface of the workpiece will be apparent to those having ordinary skill upon considering the present disclosure, and such mechanisms and techniques are within the scope of the present disclosure. A box furnace may be configured with various heating mechanisms to heat the outer surface of the workpiece one or more of flame heating mechanisms, radiant heating mechanisms, induction heating mechanisms, and/or any other heating mechanism known now or hereafter to a person having ordinary skill in the art.

In another non-limiting embodiment, the temperature of the outer surface region 36 of the workpiece 24 may be heated 54 and maintained at or near the workpiece forging temperature and within the workpiece forging temperature range using one or more die heaters 40 of a thermal management system 33. Die heaters 40 may be used to maintain the dies 42 or the die press forging surfaces 44 of the dies at or near the workpiece forging temperature or at temperatures within the temperature forging range. Die heaters 40 may heat the dies 42 or the die press forging surface 44 by any suitable heating mechanism known now or hereinafter by a person skilled in the art, including, but not limited to, flame heating mechanisms, radiant heating mechanisms, conduction heating mechanisms, and/or induction heating mechanisms. In a non-limiting embodiment, a die heater 40 may be a component of a box furnace (not shown). While the thermal management system 33 is shown in place and being used during the equilibration and cooling steps 32,52,60 of the multi-axis forging process 26 shown in FIGS. 2(*b*), (*d*), and (*f*), it is recognized that the thermal management system 33 may or may not be in place during the press forging steps 28,46,56 depicted in FIGS. 2(*a*), (*c*), and (*e*).

As shown in FIG. 2(*e*), an aspect of an embodiment of multi-axis forging 26 according to this disclosure comprises press forging (step 56) the workpiece 24 at the workpiece forging temperature in the direction (C) of a third orthogonal axis 58 of the workpiece 24 using a ram speed and strain rate that are sufficient to adiabatically heat the workpiece 24, or at least adiabatically heat an internal region of the workpiece, and plastically deform the workpiece 24. In a non-limiting embodiment, the workpiece 24 is deformed during press forging 56 to a plastic deformation of a 20-50% reduction in height or another dimension. In another non-limiting embodiment, during press forging (56) the workpiece is plastically deformed to a plastic deformation of a 30% to 40% reduction in height or another dimension. In a non-limiting embodiment, the workpiece 24 may be press forged (56) in the direction of the third orthogonal axis 58 to the same spacer height used in the first press forging step (28). In another non-limiting embodiment according to the disclosure, the internal region (not shown) of the workpiece 24 is adiabatically heated during the press forging step (56) to the same temperatures as in the first press forging step (28). In other non-limiting embodiments, the high strain rates used for press forging (56) are in the same strain rate ranges as disclosed for the first press forging step (28).

In a non-limiting embodiment, as shown by arrow 50 in 2(*b*), 2(*d*), and 2(*e*) the workpiece 24 may be rotated 50 to a different orthogonal axis between successive press forging steps (e.g., 46,56). As discussed above, this rotation may be referred to as a-b-c rotation. It is understood that by using different forge configurations, it may be possible to rotate the ram on the forge instead of rotating the workpiece 24, or a forge may be equipped with multi-axis rams so that rotation of neither the workpiece nor the forge is required. Therefore, rotating 50 the workpiece 24 may be an optional step. In most current industrial set-ups, however, rotating 50 the workpiece to a different orthogonal axis in between press forging step will be required to complete the multi-axis forging process 26.

After press forging 56 the workpiece 24 in the direction of the third orthogonal axis 58, i.e., in the C-direction, and as shown in FIG. 2(*e*), process 20 further comprises allowing (step 60) an adiabatically heated internal region (not shown) of the workpiece to cool to the workpiece forging temperature, which is indicated in FIG. 2(*f*). Internal region cooling times may range, for example, from 5 seconds to 120 seconds, from 10 seconds to 60 seconds, or from 5 seconds up to 5 minutes, and it is recognized by a person skilled in the art that the cooling times are dependent upon the size, shape, and composition of the workpiece 24, as well as the characteristics of the environment surrounding the workpiece.

During the cooling period, an aspect of a thermal management system 33, according to non-limiting embodiments disclosed herein, comprises heating (step 62) an outer surface region 36 of the workpiece 24 to a temperature at or near the workpiece forging temperature. In this manner, the temperature of the workpiece 24 is maintained in a uniform or near uniform and substantially isothermal condition at or near the workpiece forging temperature prior to each high strain rate MAF hit. In non-limiting embodiments, using the thermal management system 33 to heat the outer surface region 36, together with allowing the adiabatically heated internal region to cool for a specified internal region cooling time, the temperature of the workpiece returns to a substantially uniform temperature at or near the workpiece forging temperature between each a-b-c forging hit. In another non-limiting embodiment according to this disclosure, using the thermal management system 33 to heat the outer surface region 36, together with allowing the adiabatically heated internal region to cool for a specified internal region cooling holding time, the temperature of the workpiece returns to a substantially isothermal condition within the workpiece forging temperature range between each a-b-c forging hit.

In a non-limiting embodiment, heating 62 an outer surface region 36 of the workpiece 24 may be accomplished using one or more outer surface heating mechanisms 38 of the thermal management system 33. Examples of possible heating mechanisms 38 may include, but are not limited to, flame heaters for flame heating; induction heaters for induction heating; and/or radiant heaters for radiant heating of the workpiece 24. Other mechanisms and techniques for heating an outer surface of the workpiece will be apparent to those having ordinary skill upon considering the present disclosure, and such mechanisms and techniques are within the scope of the present disclosure. A non-limiting embodiment of a surface heating mechanism 38 may comprise a box furnace (not shown). A box furnace may be configured with various heating mechanisms to heat the outer surface of the workpiece using one or more of flame heating mechanisms, radiant heating mechanisms, induction heating mechanisms, and/or any other suitable heating mechanism known now or hereafter to a person having ordinary skill in the art.

In another non-limiting embodiment, the temperature of the outer surface region 36 of the workpiece 24 may be heated 62 and maintained at or near the workpiece forging temperature and within the workpiece forging temperature range using one or more die heaters 40 of a thermal management system 33. Die heaters 40 may be used to maintain the dies 40 or the die press forging surfaces 44 of the dies at or near the workpiece forging temperature or at temperatures within the temperature forging range. In a non-limiting embodiment, the dies 40 of the thermal management system are heated to a temperature within a range that includes the workpiece forging temperature to 100° F. (55.6° C.) below the workpiece forging temperature. Die heaters 40 may heat the dies 42 or the die press forging surface 44 by any suitable heating mechanism known now or hereinafter by a person skilled in the art, including, but not limited to, flame heating mechanisms, radiant heating mechanisms, conduction heating mechanisms, and/or induction heating mechanisms. In a non-limiting embodiment, a die heater 40 may be a component of a box furnace (not shown). While the thermal management system 33 is shown in place and being used during the equilibration steps, 32,52,60 of the multi-axis forging process show in FIGS. 2(*b*), (*d*), and (*f*), it is recognized that the thermal management system 33 may or may not be in place during the press forging steps 28,46,56 depicted in FIGS. 2(*a*), (*c*), and (*e*).

An aspect of this disclosure includes a non-limiting embodiment wherein one or more of the three orthogonal axis press forging, cooling, and surface heating steps are repeated (i.e., are conducted subsequent to completing an initial sequence of the a-b-c forging, internal region cooling, and outer surface region heating steps) until a true strain of at least 3.5 is achieved in the workpiece. The phrase "true strain" is also known to a person skilled in the art as "logarithmic strain", and also as "effective strain". Referring to FIG. 1, this is exemplified by step (g), i.e., repeating (step 64) one or more of steps (a)-(b), (c)-(d), and (e)-(f) until a true strain of at least 3.5 is achieved in the workpiece. In another non-limiting embodiment, referring again to FIG. 1, repeating 64 comprises repeating one or more of steps (a)-(b), (c)-(d), and (e)-(f) until a true strain of at least 4.7 is achieved in the workpiece. In still other non-limiting embodiments, referring again to FIG. 1, repeating 64 comprises repeating one or more of steps (a)-(b), (c)-(d), and (e)-(f) until a true strain of 5 or greater is achieved, or until a true strain of 10 is achieved in the workpiece. In another non-limiting embodiment, steps (a)-(f) shown in FIG. 1 are repeated at least 4 times.

In non-limiting embodiments of thermally managed, high strain rate multi-axis forging according to the present disclosure, after a true strain of at least 1.0, the internal region of the workpiece comprises an average alpha particle grain size from 4 μm to 6 μm. In a non-limiting embodiment of thermally controlled multi-axis forging, after a true strain of 4.7 is achieved, the workpiece comprises an average grain size in a center region of the workpiece of 4 μm. In a non-limiting embodiment according to this disclosure, when an average strain of 3.7 or greater is achieved, certain non-limiting embodiments of the methods of this disclosure produce grains that are equiaxed.

In a non-limiting embodiment of a process of multi-axis forging using a thermal management system, the workpiece-press die interface is lubricated with lubricants known to those of ordinary skill, such as, but not limited to, graphite, glasses, and/or other known solid lubricants.

In a non-limiting embodiment, the workpiece comprises a titanium alloy selected from the group consisting of alpha titanium alloys, alpha+beta titanium alloys, metastable beta titanium alloys, and beta titanium alloys. In another non-limiting embodiment, the workpiece comprises an alpha+beta titanium alloy. In still another non-limiting embodiment, the workpiece comprises a metastable beta titanium alloy. Exemplary titanium alloys that may be processed using embodiments of methods according to the present disclosure include, but are not limited to: alpha+beta titanium alloys, such as, for example, Ti-6Al-4V alloy (UNS Numbers R56400 and R54601) and Ti-6Al-2Sn-4Zr-2Mo alloy (UNS Numbers R54620 and R54621); near-beta titanium alloys, such as, for example, Ti-10V-2Fe-3Al alloy (UNS R54610)); and metastable beta titanium alloys, such as, for example, Ti-15Mo alloy (UNS R58150) and Ti-5Al-5V-5Mo-3Cr alloy (UNS unassigned). In a non-limiting embodiment, the workpiece comprises a titanium alloy that is selected from ASTM Grades 5, 6, 12, 19, 20, 21, 23, 24, 25, 29, 32, 35, 36, and 38 titanium alloys.

In a non-limiting embodiment, heating a workpiece to a workpiece forging temperature within an alpha+beta phase field of the titanium or titanium alloy metallic material comprises heating the workpiece to a beta soaking temperature; holding the workpiece at the beta soaking temperature for a soaking time sufficient to form a 100% titanium beta phase microstructure in the workpiece; and cooling the workpiece directly to the workpiece forging temperature. In certain non-limiting embodiments, the beta soaking temperature is in a temperature range of the beta transus temperature of the titanium or titanium alloy metallic material up to 300° F. (111° C.) above the beta transus temperature of the titanium or titanium alloy metallic material. Non-limiting embodiments comprise a beta soaking time from 5 minutes to 24 hours. A person skilled in the art will understand that other beta soaking temperatures and beta soaking times are within the scope of embodiments of this disclosure and, for example, that relatively large workpieces may require relatively higher beta soaking temperatures and/or longer beta soaking times to form a 100% beta phase titanium microstructure.

In certain non-limiting embodiments in which the workpiece is held at a beta soaking temperature to form a 100% beta phase microstructure, the workpiece may also be plastically deformed at a plastic deformation temperature in the beta phase field of the titanium or titanium alloy metallic material prior to cooling the workpiece to the workpiece forging temperature. Plastic deformation of the workpiece may comprise at least one of drawing, upset forging, and high strain rate multi-axis forging the workpiece. In a non-limiting embodiment, plastic deformation in the beta phase region comprises upset forging the workpiece to a beta-upset strain in the range of 0.1-0.5. In non-limiting embodiments, the plastic deformation temperature is in a temperature range including the beta transus temperature of the titanium or titanium alloy metallic material up to 300° F. (111° C.) above the beta transus temperature of the titanium or titanium alloy metallic material.

Figure 4:
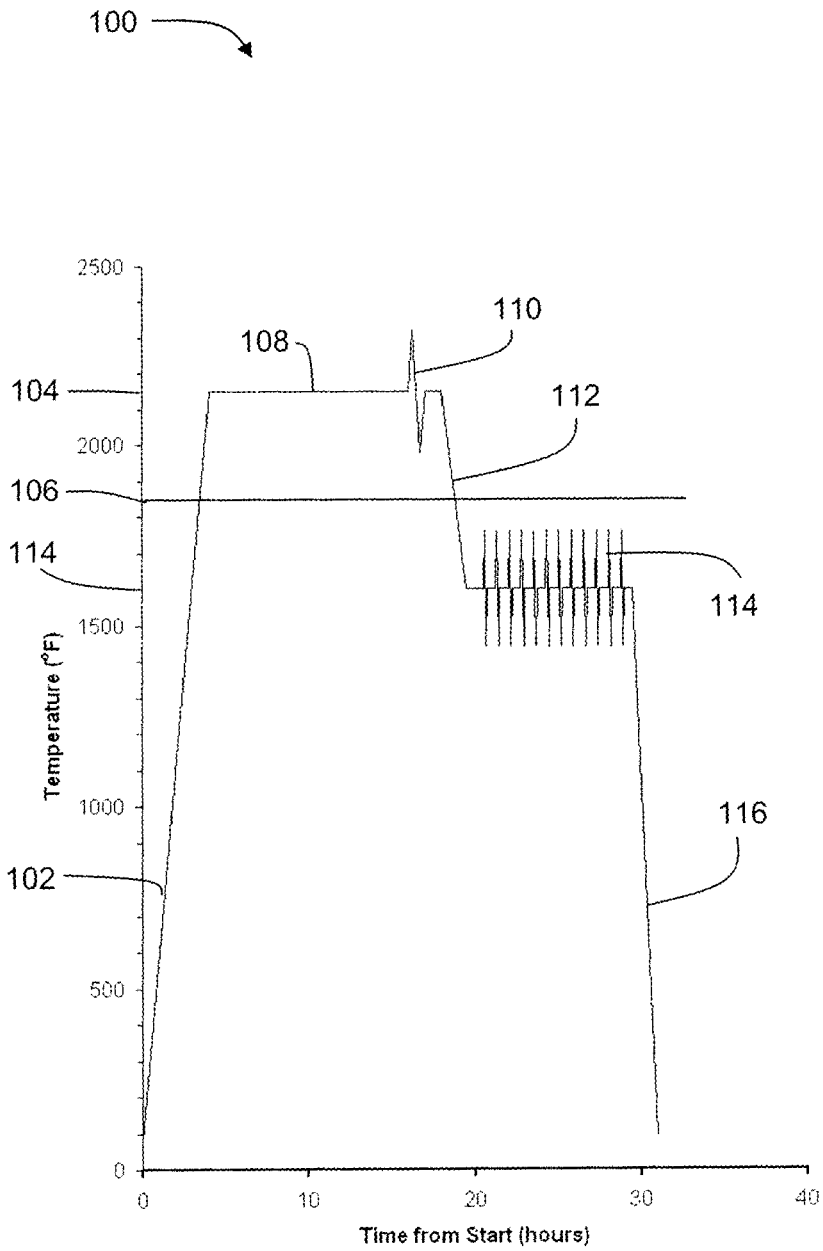
FIG. 4 is a schematic representation of a temperature-time thermomechanical process chart for a non-limiting embodiment of a high strain rate multi-axis forging method according to the present disclosure.

FIG. 4 is a schematic temperature-time thermomechanical process chart for a non-limiting method of plastically deforming the workpiece above the beta transus temperature and directly cooling to the workpiece forging temperature. In FIG. 4, a non-limiting method 100 comprises heating 102 the workpiece to a beta soaking temperature 104 above the beta transus temperature 106 of the titanium or titanium alloy metallic material and holding or "soaking" 108 the workpiece at the beta soaking temperature 104 to form an all beta titanium phase microstructure in the workpiece. In a non-limiting embodiment according to this disclosure, after soaking 108 the workpiece may be plastically deformed 110. In a non-limiting embodiment, plastic deformation 110 comprises upset forging. In another non-limiting embodiment, plastic deformation 110 comprises upset forging to a true strain of 0.3. In another non-limiting embodiment, plastically deforming 110 the workpiece comprises thermally managed high strain rate multi-axis forging (not shown in FIG. 4) at a beta soaking temperature.

Still referring to FIG. 4, after plastic deformation 110 in the beta phase field, in a non-limiting embodiment, the workpiece is cooled 112 to a workpiece forging temperature 114 in the alpha+beta phase field of the titanium or titanium alloy metallic material. In a non-limiting embodiment, cooling 112 comprises air cooling. After cooling 112, the workpiece is thermally managed high strain rate multi-axis forged 114, according to non-limiting embodiments of this disclosure. In the non-limiting embodiment of FIG. 4, the workpiece is hit or press forged 12 times, i.e., the three orthogonal axes of the workpiece are non-sequentially press forged a total of 4 times each. In other words, referring to FIG. 1, the sequence including steps (a)-(b), (c)-(d), and (e)-(f) is performed 4 times. In the non-limiting embodiment of FIG. 4, after a multi-axis forging sequence involving 12 hits, the true strain may equal, for example, approximately 3.7. After a multi-axis forging 114, the workpiece is cooled 116 to room temperature. In a non-limiting embodiment, cooling 116 comprises air cooling.

Figure 5:
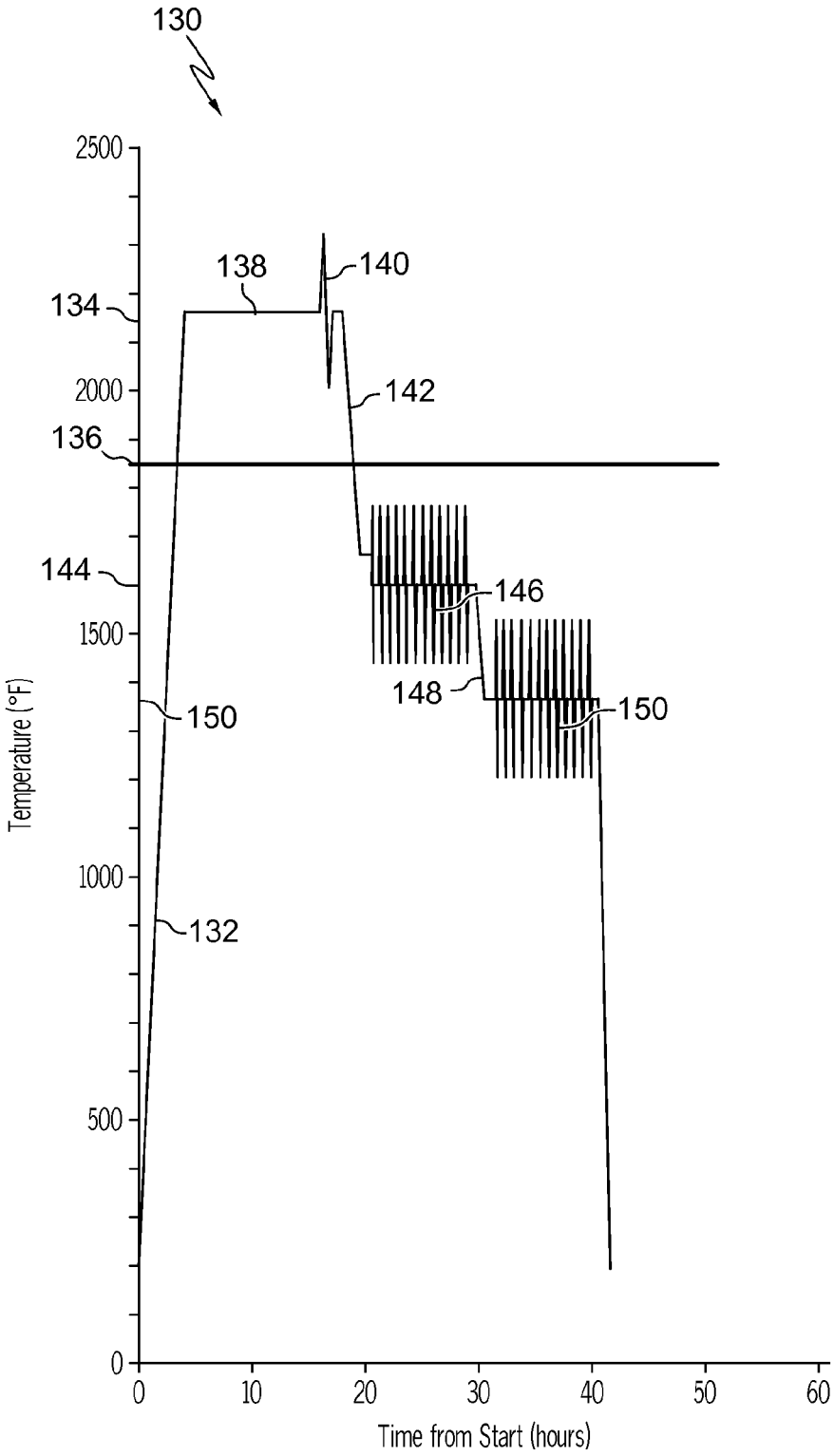
FIG. 5 is a schematic representation of temperature-time thermomechanical process chart for a non-limiting embodiment of a multi-temperature high strain rate multi-axis forging method according to the present disclosure.

A non-limiting aspect of this disclosure includes thermally managed high strain rate multi-axis forging at two temperatures in the alpha+beta phase field. FIG. 5 is a schematic temperature-time thermomechanical process chart for a non-limiting method that comprises multi-axis forging the titanium alloy workpiece at the first workpiece forging temperature utilizing a non-limiting embodiment of the thermal management feature disclosed hereinabove, followed by cooling to a second workpiece forging temperature in the alpha+beta phase, and multi-axis forging the titanium alloy workpiece at the second workpiece forging temperature utilizing a non-limiting embodiment of the thermal management feature disclosed hereinabove.

In FIG. 5, a non-limiting method 130 comprises heating 132 the workpiece to a beta soaking temperature 134 above the beta transus temperature 136 of the alloy and holding or soaking 138 the workpiece at the beta soaking temperature 134 to form an all beta phase microstructure in the titanium or titanium alloy workpiece. After soaking 138, the workpiece may be plastically deformed 140. In a non-limiting embodiment, plastic deformation 140 comprises upset forging. In another non-limiting embodiment, plastic deformation 140 comprises upset forging to a strain of 0.3. In yet another non-limiting embodiment, plastically deforming 140 the workpiece comprises thermally managed high stain multi-axis forging (not shown in FIG. 5), at a beta soaking temperature.

Still referring to FIG. 5, after plastic deformation 140 in the beta phase field, the workpiece is cooled 142 to a first workpiece forging temperature 144 in the alpha+beta phase field of the titanium or titanium alloy metallic material. In a non-limiting embodiment, cooling 142 comprises air cooling. After cooling 142, the workpiece is high strain rate multi-axis forged 146 at the first workpiece forging temperature employing a thermal management system according to non-limiting embodiments disclosed herein. In the non-limiting embodiment of FIG. 5, the workpiece is hit or press forged at the first workpiece forging temperature 12 times with 90° rotation between each hit, i.e., the three orthogonal axes of the workpiece are press forged 4 times each. In other words, referring to FIG. 1, the sequence including steps (a)-(b), (c)-(d), and (e)-(f) is performed 4 times. In the non-limiting embodiment of FIG. 5, after high strain rate multi-axis forging 146 the workpiece at the first workpiece forging temperature, the titanium alloy workpiece is cooled 148 to a second workpiece forging temperature 150 in the alpha+beta phase field. After cooling 148, the workpiece is high strain rate multi-axis forged 150 at the second workpiece forging temperature employing a thermal management system according to non-limiting embodiments disclosed herein. In the non-limiting embodiment of FIG. 5, the workpiece is hit or press forged at the second workpiece forging temperature a total of 12 times. It is recognized that the number of hits applied to the titanium alloy workpiece at the first and second workpiece forging temperatures can vary depending upon the desired true strain and desired final grain size, and that the number of hits that is appropriate can be determined without undue experimentation. After multi-axis forging 150 at the second workpiece forging temperature, the workpiece is cooled 152 to room temperature. In a non-limiting embodiment, cooling 152 comprises air cooling to room temperature.

In a non-limiting embodiment, the first workpiece forging temperature is in a first workpiece forging temperature range of more than 200° F. (111.1° C.) below the beta transus temperature of the titanium or titanium alloy metallic material to 500° F. (277.8° C.) below the beta transus temperature of the titanium or titanium alloy metallic material, i.e., the first workpiece forging temperature $T_1$ is in the range of $T_\beta$-200° F.>$T_1 \geq T_\beta$-500° F. In a non-limiting embodiment, the second workpiece forging temperature is in a second workpiece forging temperature range of more than 500° F. (277.8° C.) below the beta transus temperature of the titanium or titanium alloy metallic material to 700° F. (388.9° C.) below the beta transus temperature, i.e., the second workpiece forging temperature $T_2$ is in the range of $T_\beta$-500° F.>$T_2 \geq T_\beta$-700° F. In a non-limiting embodiment, the titanium alloy workpiece comprises Ti-6-4 alloy; the first workpiece temperature is 1500° F. (815.6° C.); and the second workpiece forging temperature is 1300° F. (704.4° C.).

Figure 6:
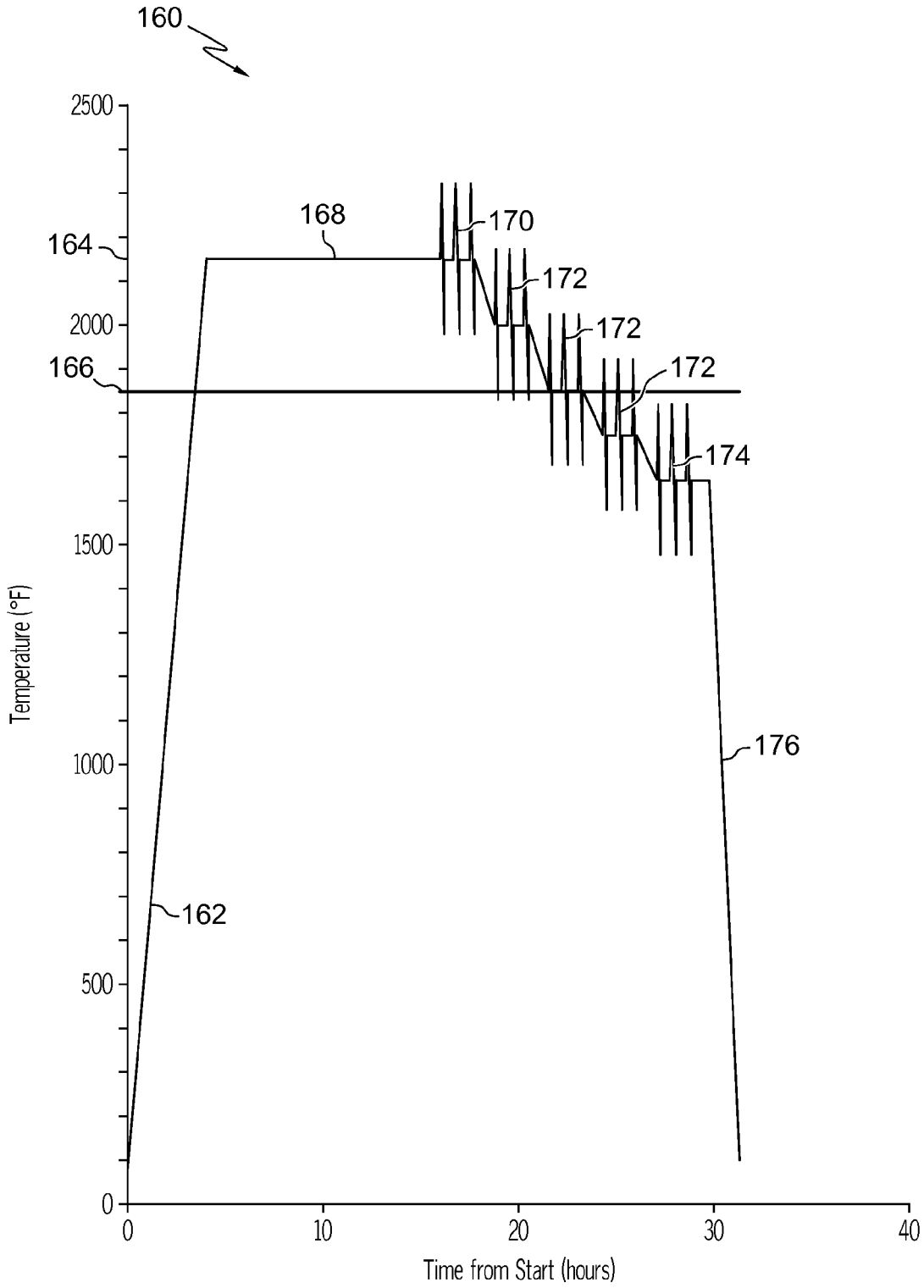
FIG. 6 is a schematic representation of temperature-time thermomechanical process chart for a non-limiting embodiment of a through beta transus high strain rate multi-axis forging method according the present disclosure.

FIG. 6 is a schematic temperature-time thermomechanical process chart of a non-limiting method according to the present disclosure of plastically deforming a workpiece comprising a metallic material selected from titanium and a titanium alloy above the beta transus temperature and cooling the workpiece to the workpiece forging temperature, while simultaneously employing thermally managed high strain rate multi-axis forging on the workpiece according to non-limiting embodiments of this disclosure. In FIG. 6, a non-limiting method 160 of using thermally managed high strain rate multi-axis forging for grain refining of titanium or a titanium alloy comprises heating 162 the workpiece to a beta soaking temperature 164 above the beta transus temperature 166 of the titanium or titanium alloy metallic material and holding or soaking 168 the workpiece at the beta soaking temperature 164 to form an all beta phase microstructure in the workpiece. After soaking 168 the workpiece at the beta soaking temperature, the workpiece is plastically deformed 170. In a non-limiting embodiment, plastic deformation 170 may comprise thermally managed high strain rate multi-axis forging. In a non limiting embodiment, the workpiece is repetitively high strain rate multi-axis forged 172 using a thermal management system as disclosed herein as the workpiece cools through the beta transus temperature. FIG. 6 shows three intermediate high strain rate multi-axis forging 172 steps, but it will be understood that there can be more or fewer intermediate high strain rate multi-axis forging 172 steps, as desired. The intermediate high strain rate multi-axis forging 172 steps are intermediate to the initial high strain rate multi-axis forging step 170 at the soaking temperature, and the final high strain rate multi-axis forging step in the alpha+beta phase field 174 of the metallic material. While FIG. 6 shows one final high strain rate multi-axis forging step wherein the temperature of the workpiece remains entirely in the alpha+beta phase field, it is understood that more than one multi-axis forging step could be performed in the alpha+beta phase field for further grain refinement. According to non-limiting embodiments of this disclosure, at least one final high strain rate multi-axis forging step takes place entirely at temperatures in the alpha+beta phase field of the titanium or titanium alloy workpiece.

Because the multi-axis forging steps 170,172,174 take place as the temperature of the workpiece cools through the beta transus temperature of the titanium or titanium alloy metallic material, a method embodiment such as is shown in FIG. 6 is referred to herein as "through beta transus high strain rate multi-axis forging". In a non-limiting embodiment, the thermal management system (33 of FIG. 2) is used in through beta transus multi-axis forging to maintain the temperature of the workpiece at a uniform or substantially uniform temperature prior to each hit at each through beta transus forging temperature and, optionally, to slow the cooling rate After final multi-axis forging 174 the workpiece, the workpiece is cooled 176 to room temperature. In a non-limiting embodiment, cooling 176 comprises air cooling.

Non-limiting embodiments of multi-axis forging using a thermal management system, as disclosed hereinabove, can be used to process titanium and titanium alloy workpieces having cross sections greater than 4 square inches using conventional forging press equipment, and the size of cubic workpieces can be scaled to match the capabilities of an individual press. It has been determined that alpha lamellae from the β-annealed structure break down easily to fine uniform alpha grains at workpiece forging temperatures disclosed in non-limiting embodiments herein. It has also been determined that decreasing the workpiece forging temperature decreases the alpha particle size (grain size).

While not wanting to be held to any particular theory, it is believed that grain refinement that occurs in non-limiting embodiments of thermally managed, high strain rate multi-axis forging according to this disclosure occurs via meta-dynamic recrystallization. In the prior art slow strain rate multi-axis forging process, dynamic recrystallization occurs instantaneously during the application of strain to the material. It is believed that in high strain rate multi-axis forging according to this disclosure, meta-dynamic recrystallization occurs at the end of each deformation or forging hit, while at least the internal region of the workpiece is hot from adiabatic heating. Residual adiabatic heat, internal region cooling times, and external surface region heating influence the extent of grain refinement in non-limiting methods of thermally managed, high strain rate multi-axis forging according to this disclosure.

Multi-axis forging using a thermal management system and cube-shaped workpieces comprising a metallic material selected from titanium and titanium alloys, as disclosed hereinabove, has been observed to produce certain less than optimal results. It is believed that one or more of (1) the cubic workpiece geometry used in certain embodiments of thermally managed multi-axis forging disclosed herein, (2) die chill (i.e., letting the temperature of the dies dip significantly below the workpiece forging temperature), and (3) use of high strain rates concentrates strain at the core region of the workpiece.

An aspect of the present disclosure comprises forging methods that can achieve generally uniform fine grain, very fine grain or ultrafine grain size in billet-size titanium alloys. In other words, a workpiece processed by such methods may include the desired grain size, such as ultrafine grain microstructure throughout the workpiece, rather than only in a central region of the workpiece. Non-limiting embodiments of such methods use "multiple upset and draw" steps on billets having cross-sections greater than 4 square inches. The multiple upset and draw steps are aimed at achieving uniform fine grain, very fine grain or ultrafine grain size throughout the workpiece, while preserving substantially the original dimensions of the workpiece. Because these forging methods include multiple upset and draw steps, they are referred to herein as embodiments of the "MUD" method. The MUD method includes severe plastic deformation and can produce uniform ultrafine grains in billet size titanium alloy workpieces. In non-limiting embodiments according to this disclosure, strain rates used for the upset forging and draw forging steps of the MUD process are in the range of 0.001 $s^{-1}$ to 0.02 $s^{-1}$, inclusive. In contrast, strain rates typically used for conventional open die upset and draw forging are in the range of 0.03 $s^{-1}$ to 0.1 $s^{-}$. The strain rate for MUD is slow enough to prevent adiabatic heating in order to keep the forging temperature in control, yet the strain rate is acceptable for commercial practices.

Figure 7:
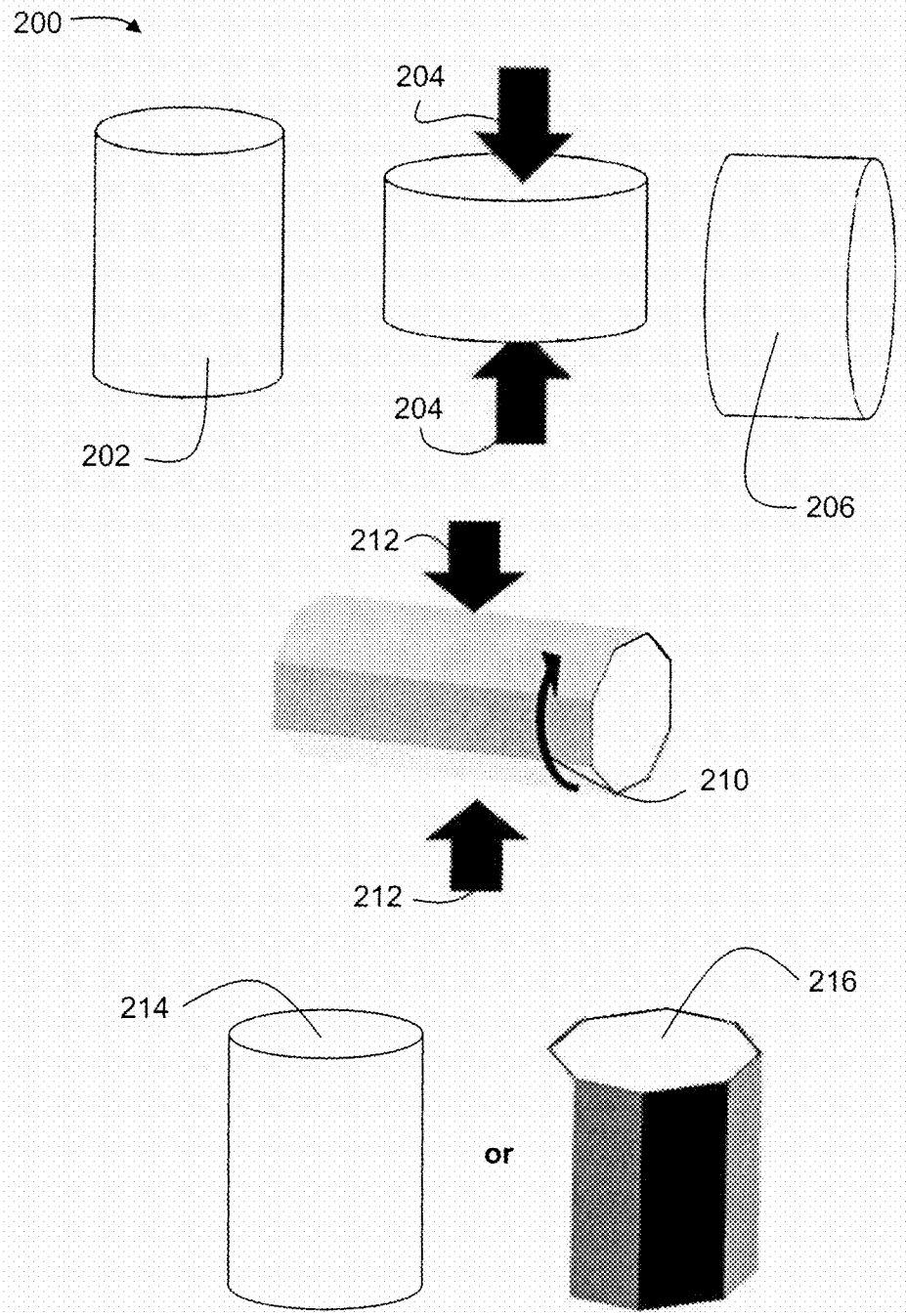
FIG. 7 is a schematic representation of a non-limiting embodiment of a multiple upset and draw method for grain size refinement according to the present disclosure.
Figure 8:
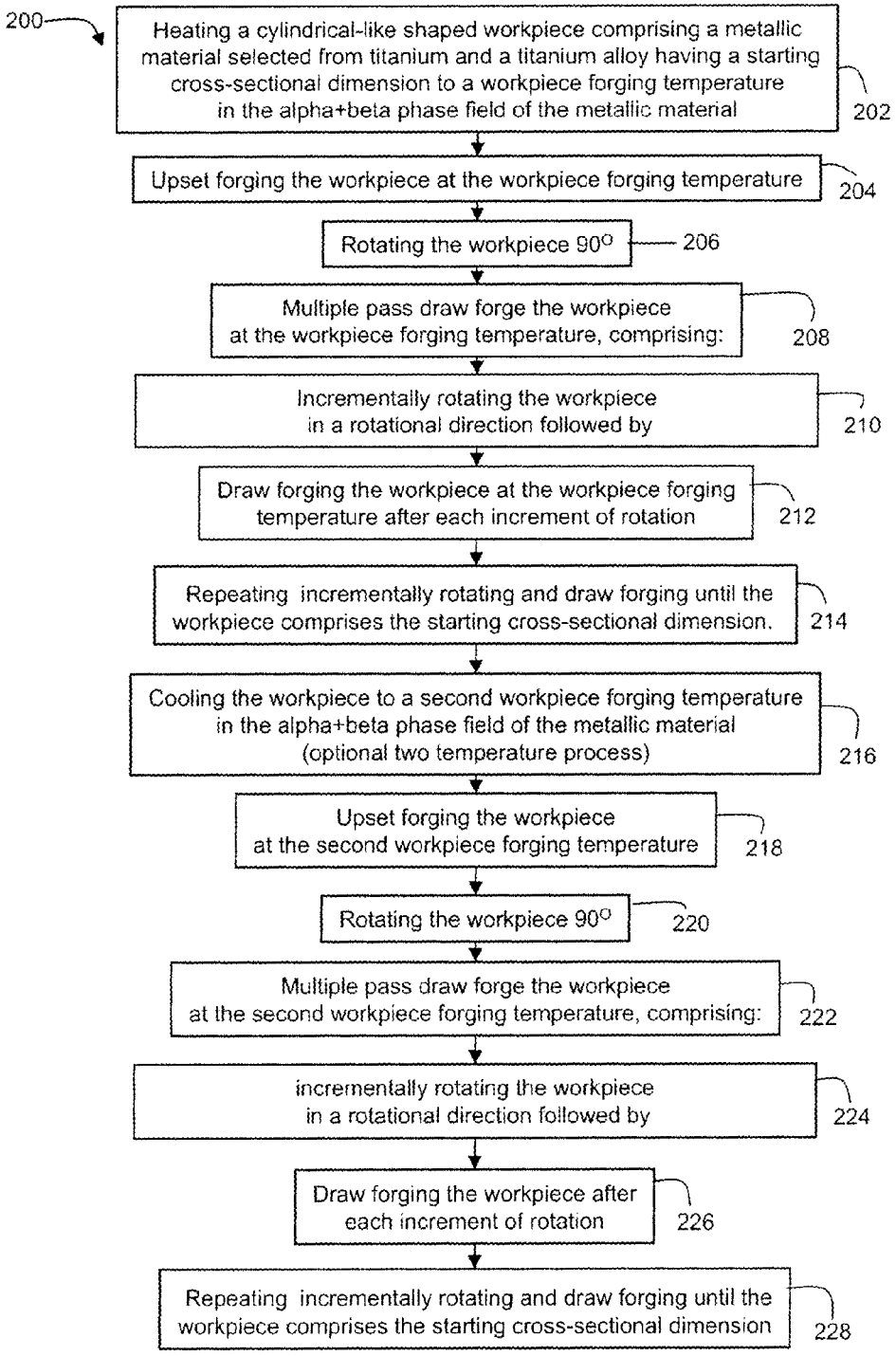
FIG. 8 is a flow chart listing steps of a non-limiting embodiment of a method according to the present disclosure for multiple upset and draw processing titanium and titanium alloys to refine grain size.

A schematic representation of non-limiting embodiments of the multiple upset and draw, i.e., "MUD" method is provided in FIG. 7, and a flow chart of certain embodiments of the MUD method is provided in FIG. 8. Referring to FIGS. 7 and 8, a non-limiting method 200 for refining grains in a workpiece comprising a metallic material selected from titanium and a titanium alloy using multiple upset and draw forging steps comprises heating 202 a cylinder-like titanium or titanium alloy metallic material workpiece to a workpiece forging temperature in the alpha+beta phase field of the metallic material. In a non-limiting embodiment, the shape of the cylinder-like workpiece is a cylinder. In another non limiting embodiment, the shape of the cylinder-like workpiece is an octagonal cylinder or a right octagon.

The cylinder-like workpiece has a starting cross-sectional dimension. In a non-limiting embodiment of the MUD method according to the present disclosure in which the starting workpiece is a cylinder, the starting cross-sectional dimension is the diameter of the cylinder. In a non-limiting embodiment of the MUD method according to the present disclosure in which the starting workpiece is an octagonal cylinder, the starting cross-sectional dimension is the diameter of the circumscribed circle of the octagonal cross-section, i.e., the diameter of the circle that passes through all the vertices of the octagonal cross-section.

When the cylinder-like workpiece is at the workpiece forging temperature, the workpiece is upset forged 204. After upset forging 204, in a non-limiting embodiment, the workpiece is rotated (206) 90° and then is subjected to multiple pass draw forging 208. Actual rotation 206 of the workpiece is optional, and the objective of the step is to dispose the workpiece into the correct orientation (refer to FIG. 7) relative to a forging device for subsequent multiple pass draw forging 208 steps.

Multiple pass draw forging comprises incrementally rotating (depicted by arrow 210) the workpiece in a rotational direction (indicated by the direction of arrow 210), followed by draw forging 212 the workpiece after each increment of rotation. In non-limiting embodiments, incrementally rotating and draw forging is repeated 214 until the workpiece comprises the starting cross-sectional dimension. In a non-limiting embodiment, the upset forging and multiple pass draw forging steps are repeated until a true strain of at least 3.5 is achieved in the workpiece. Another non-limiting embodiment comprises repeating the heating, upset forging, and multiple pass draw forging steps until a true strain of at least 4.7 is achieved in the workpiece. In still another non-limiting embodiment, the heating, upset forging, and multiple pass draw forging steps are repeated until a true strain of at least 10 is achieved in the workpiece. It is observed in non-limiting embodiments that when a true strain of 10 imparted to the MUD forging, a UFG alpha microstructure is produced, and that increasing the true strain imparted to the workpiece results smaller average grain sizes.

An aspect of this disclosure is to employ a strain rate during the upset and multiple drawing steps that is sufficient to result in severe plastic deformation of the titanium alloy workpiece, which, in non-limiting embodiments, further results in ultrafine grain size. In a non limiting embodiment, a strain rate used in upset forging is in the range of 0.001 $s^{-1}$ to 0.003 $s^{-1}$. In another non-limiting embodiment, a strain rate used in the multiple draw forging steps is the range of 0.01 $s^{-1}$ to 0.02 $s^{-1}$. It is determined that strain rates in these ranges do not result in adiabatic heating of the workpiece, which enables workpiece temperature control, and are sufficient for an economically acceptable commercial practice.

In a non-limiting embodiment, after completion of the MUD method, the workpiece has substantially the original dimensions of the starting cylinder 214 or octagonal cylinder 216. In yet another non-limiting embodiment, after completion of the MUD method, the workpiece has substantially the same cross-section as the starting workpiece. In a non-limiting embodiment, a single upset requires many draw hits to return the workpiece to a shape including the starting cross-section of the workpiece.

In a non-limiting embodiment of the MUD method wherein the workpiece is in the shape of a cylinder, incrementally rotating and draw forging further comprises multiples steps of rotating the cylindrical workpiece in 15° increments and subsequently draw forging, until the cylindrical workpiece is rotated through 360° and is draw forged at each increment. In a non-limiting embodiment of the MUD method wherein the workpiece is in the shape of a cylinder, after each upset forge, twenty-four incremental rotation+draw forging steps are employed to bring the workpiece to substantially its starting cross-sectional dimension. In another non-limiting embodiment, when the workpiece is in the shape of an octagonal cylinder, incrementally rotating and draw forging further comprises multiples steps of rotating the cylindrical workpiece in 45° increments and subsequently draw forging, until the cylindrical workpiece is rotated through 360° and is draw forged at each increment. In a non-limiting embodiment of the MUD method wherein the workpiece is in the shape of an octagonal cylinder, after each upset forge, eight incremental rotation+draw forging steps are employed to bring the workpiece substantially to its starting cross-sectional dimension. It was observed in non-limiting embodiments of the MUD method that manipulation of an octagonal cylinder by handling equipment was more precise than manipulation of a cylinder by handling equipment. It also was observed that manipulation of an octagonal cylinder by handling equipment in a non-limiting embodiment of a MUD was more precise than manipulation of a cubic workpiece using hand tongs in non-limiting embodiments of the thermally managed high strain rate MAF process disclosed herein. It is recognized that other amounts of incremental rotation and draw forging steps for cylinder-like billets are within the scope of this disclosure, and such other possible amounts of incremental rotation may be determined by a person skilled in the art without undue experimentation.

In a non-limiting embodiment of MUD according to this disclosure, a workpiece forging temperature comprises a temperature within a workpiece forging temperature range. In a non-limiting embodiment, the workpiece forging temperature is in a workpiece forging temperature range of 100° F. (55.6° C.) below the beta transus temperature ($T_\beta$) of the titanium or titanium alloy metallic material to 700° F. (388.9° C.) below the beta transus temperature of the titanium or titanium alloy metallic material. In still another non-limiting embodiment, the workpiece forging temperature is in a temperature range of 300° F. (166.7° C.) below the beta transition temperature of the titanium or titanium alloy metallic material to 625° F. (347° C.) below the beta transition temperature of the titanium or titanium alloy metallic material. In a non-limiting embodiment, the low end of a workpiece forging temperature range is a temperature in the alpha+beta phase field at which substantial damage does not occur to the surface of the workpiece during the forging hit, as may be determined without undue experimentation by a person having ordinary skill in the art.

In a non-limiting MUD embodiment according to the present disclosure, the workpiece forging temperature range for a Ti-6-4 alloy (Ti-6Al-4V; UNS No. R56400), which has a beta transus temperature ($T_\beta$) of about 1850° F. (1010° C.), may be, for example, from 1150° F. (621.1° C.) to 1750° F. (954.4° C.), or in another embodiment may be from 1225° F. (662.8° C.) to 1550° F. (843.3° C.).

Non-limiting embodiments comprise multiple reheating steps during the MUD method. In a non-limiting embodiment, the titanium alloy workpiece is heated to the workpiece forging temperature after upset forging the titanium alloy workpiece. In another non-limiting embodiment, the titanium alloy workpiece is heated to the workpiece forging temperature prior to a draw forging step of the multiple pass draw forging. In another non-limiting embodiment, the workpiece is heated as needed to bring the actual workpiece temperature back to the workpiece forging temperature after an upset or draw forging step.

It was determined that embodiments of the MUD method impart redundant work or extreme deformation, also referred to as severe plastic deformation, which is aimed at creating ultrafine grains in a workpiece comprising a metallic material selected from titanium and a titanium alloy. Without intending to be bound to any particular theory of operation, it is believed that the round or octagonal cross sectional shape of cylindrical and octagonal cylindrical workpieces, respectively, distributes strain more evenly across the cross-sectional area of the workpiece during a MUD method. The deleterious effect of friction between the workpiece and the forging die is also reduced by reducing the area of the workpiece in contact with the die.

In addition, it was also determined that decreasing the temperature during the MUD method reduces the final grain size to a size that is characteristic of the specific temperature being used. Referring to FIG. 8, in a non-limiting embodiment of a method 200 for refining the grain size of a workpiece, after processing by the MUD method at the workpiece forging temperature, the temperature of the workpiece may be cooled 216 to a second workpiece forging temperature. After cooling the workpiece to the second workpiece forging temperature, in a non-limiting embodiment, the workpiece is upset forged at the second workpiece forging temperature 218. The workpiece is rotated 220 or oriented for subsequent draw forging steps. The workpiece is multiple-step draw forged at the second workpiece forging temperature 222. Multiple-step draw forging at the second workpiece forging temperature 222 comprises incrementally rotating 224 the workpiece in a rotational direction (refer to FIG. 7), and draw forging at the second workpiece forging temperature 226 after each increment of rotation. In a non-limiting embodiment, the steps of upset, incrementally rotating 224, and draw forging are repeated 226 until the workpiece comprises the starting cross-sectional dimension. In another non-limiting embodiment, the steps of upset forging at the second workpiece temperature 218, rotating 220, and multiple step draw forging 222 are repeated until a true strain of 10 or greater is achieved in the workpiece. It is recognized that the MUD process can be continued until any desired true strain is imparted to the titanium or titanium alloy workpiece.

In a non-limiting embodiment comprising a multi-temperature MUD method, the workpiece forging temperature, or a first workpiece forging temperature, is about 1600° F. (871.1° C.) and the second workpiece forging temperature is about 1500° F. (815.6° C.). Subsequent workpiece forging temperatures that are lower than the first and second workpiece forging temperatures, such as a third workpiece forging temperature, a fourth workpiece forging temperature, and so forth, are within the scope of non-limiting embodiments of this disclosure.

As forging proceeds, grain refinement results in decreasing flow stress at a fixed temperature. It was determined that decreasing the forging temperature for sequential upset and draw steps keeps the flow stress constant and increases the rate of microstructural refinement. It has been determined that in non-limiting embodiments of MUD according to this disclosure, a true strain of 10 results in a uniform equiaxed alpha ultrafine grain microstructure in titanium and titanium alloy workpieces, and that the lower temperature of a two-temperature (or multi-temperature) MUD process can be determinative of the final grain size after a true strain of 10 is imparted to the MUD forging.

An aspect of this disclosure includes that after processing by the MUD method, subsequent deformation steps are possible without coarsening the refined grain size, as long as the temperature of the workpiece is not subsequently heated above the beta transus temperature of the titanium alloy. For example, in a non-limiting embodiment, a subsequent deformation practice after MUD processing may include draw forging, multiple draw forging, upset forging, or any combination of two or more of these forging steps at temperatures in the alpha+beta phase field of the titanium or titanium alloy. In a non-limiting embodiment, subsequent deformation or forging steps include a combination of multiple pass draw forging, upset forging, and draw forging to reduce the starting cross-sectional dimension of the cylinder-like workpiece to a fraction of the cross-sectional dimension, such as, for example, but not limited to, one-half of the cross-sectional dimension, one-quarter of the cross-sectional dimension, and so forth, while still maintaining a uniform fine grain, very fine grain or ultrafine grain structure in the titanium or titanium alloy workpiece.

In a non-limiting embodiment of a MUD method, the workpiece comprises a titanium alloy selected from the group consisting of an alpha titanium alloy, an alpha+beta titanium alloy, a metastable beta titanium alloy, and a beta titanium alloy. In another non-limiting embodiment of a MUD method, the workpiece comprises an alpha+beta titanium alloy. In still another non-limiting embodiment of the multiple upset and draw process disclosed herein, the workpiece comprises a metastable beta titanium alloy. In a non-limiting embodiment of a MUD method, the workpiece is a titanium alloy selected from ASTM Grades 5, 6, 12, 19, 20, 21, 23, 24, 25, 29, 32, 35, 36, and 38 titanium alloys.

Prior to heating the workpiece to the workpiece forging temperature in the alpha+beta phase field according to MUD embodiments of this disclosure, in a non-limiting embodiment the workpiece may be heated to a beta soaking temperature, held at the beta soaking temperature for a beta soaking time sufficient to form a 100% beta phase titanium microstructure in the workpiece, and cooled to room temperature. In a non-limiting embodiment, the beta soaking temperature is in a beta soaking temperature range that includes the beta transus temperature of the titanium or titanium alloy up to 300° F. (111° C.) above the beta transus temperature of the titanium or titanium alloy. In another non-limiting embodiment, the beta soaking time is from 5 minutes to 24 hours.

In a non-limiting embodiment, the workpiece is a billet that is coated on all or certain surfaces with a lubricating coating that reduces friction between the workpiece and the forging dies. In a non-limiting embodiment, the lubricating coating is a solid lubricant such as, but not limited to, one of graphite and a glass lubricant. Other lubricating coatings known now or hereafter to a person having ordinary skill in the art are within the scope of this disclosure. In addition, in a non-limiting embodiment of the MUD method using cylinder-like workpieces, the contact area between the workpiece and the forging dies is small relative to the contact area in multi-axis forging of a cubic workpiece. The reduced contact area results in reduced die friction and a more uniform titanium alloy workpiece microstructure and macrostructure.

Prior to heating the workpiece comprising a metallic material selected from titanium and titanium alloys to the workpiece forging temperature in the alpha+beta phase field according to MUD embodiments of this disclosure, in a non-limiting embodiment, the workpiece is plastically deformed at a plastic deformation temperature in the beta phase field of the titanium or titanium alloy metallic material after being held at a beta soaking time sufficient to form 100% beta phase in the titanium or titanium alloy and prior to cooling to room temperature. In a non-limiting embodiment, the plastic deformation temperature is equivalent to the beta soaking temperature. In another non-limiting embodiment, the plastic deformation temperature is in a plastic deformation temperature range that includes the beta transus temperature of the titanium or titanium alloy up to 300° F. (111° C.) above the beta transus temperature of the titanium or titanium alloy.

In a non-limiting embodiment, plastically deforming the workpiece in the beta phase field of the titanium or titanium alloy comprises at least one of drawing, upset forging, and high strain rate multi-axis forging the titanium alloy workpiece. In another non-limiting embodiment, plastically deforming the workpiece in the beta phase field of the titanium or titanium alloy comprises multiple upset and draw forging according to non-limiting embodiments of this disclosure, and wherein cooling the workpiece to the workpiece forging temperature comprises air cooling. In still another non-limiting embodiment, plastically deforming the workpiece in the beta phase field of the titanium or titanium alloy comprises upset forging the workpiece to a 30-35% reduction in height or another dimension, such as length.

Another aspect of this disclosure may include heating the forging dies during forging. A non-limiting embodiment comprises heating dies of a forge used to forge the workpiece to temperature in a temperature range bounded by the workpiece forging temperature to 100° F. (55.6° C.) below the workpiece forging temperature, inclusive.

It is believed that the certain methods disclosed herein also may be applied to metals and metal alloys other than titanium and titanium alloys in order to reduce the grain size of workpieces of those alloys. Another aspect of this disclosure includes non-limiting embodiments of a method for high strain rate multi-step forging of metals and metal alloys. A non-limiting embodiment of the method comprises heating a workpiece comprising a metal or a metal alloy to a workpiece forging temperature. After heating, the workpiece is forged at the workpiece forging temperature at a strain rate sufficient to adiabatically heat an internal region of the workpiece. After forging, a waiting period is employed before the next forging step. During the waiting period, the temperature of the adiabatically heated internal region of the metal alloy workpiece is allowed to cool to the workpiece forging temperature, while at least a one surface region of the workpiece is heated to the workpiece forging temperature. The steps of forging the workpiece and then allowing the adiabatically heated internal region of the workpiece to equilibrate to the workpiece forging temperature while heating at least one surface region of the metal alloy workpiece to the workpiece forging temperature are repeated until a desired characteristic is obtained. In a non-limiting embodiment, forging comprises one or more of press forging, upset forging, draw forging, and roll forging. In another non-limiting embodiment, the metal alloy is selected from the group consisting of titanium alloys, zirconium and zirconium alloys, aluminum alloys, ferrous alloys, and superalloys. In still another non-limiting embodiment, the desired characteristic is one or more of an imparted strain, an average grain size, a shape, and a mechanical property. Mechanical properties include, but are not limited to, strength, ductility, fracture toughness, and hardness.

Several examples illustrating certain non-limiting embodiments according to the present disclosure follow.

Example 1

Multi-axis forging using a thermal management system was performed on a titanium alloy workpiece consisting of alloy Ti-6-4 having equiaxed alpha grains with grain sizes in the range of 10-30 μm. A thermal management system was employed that included heated dies and flame heating to heat the surface region of the titanium alloy workpiece. The workpiece consisted of a 4-inch sided cube. The workpiece was heated in a gas-fired box furnace to a beta annealing temperature of 1940° F. (1060° C.), i.e., about 50° F. (27.8° C.) above the beta transus temperature. The beta anneal soaking time was 1 hour. The beta annealed workpiece was air cooled to room temperature, i.e., about 70° F. (21.1° C.).

Figure 9:
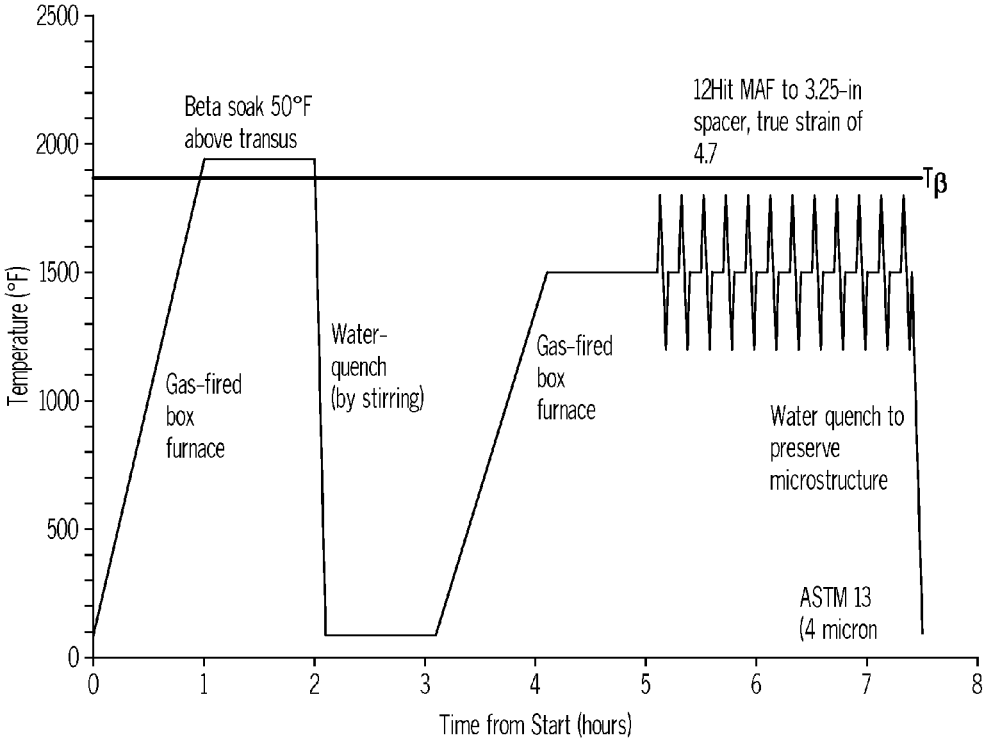
FIG. 9 is a temperature-time thermomechanical chart for the non-limiting embodiment of Example 1 of this disclosure.

The beta annealed workpiece was then heated in a gas-fired box furnace to the workpiece forging temperature of 1500° F. (815.6° C.), which is in the alpha+beta phase field of the alloy. The beta annealed workpiece was first press forged in the direction of the A axis of the workpiece to a spacer height of 3.25 inches. The ram speed of the press forge was 1 inch/second, which corresponded to a strain rate of 0.27 $s^{-1}$. The adiabatically heated center of the workpiece and the flame heated surface region of the workpiece were allowed to equilibrate to the workpiece forging temperature for about 4.8 minutes. The workpiece was rotated and press forged in the direction of the B axis of the workpiece to a spacer height of 3.25 inches. The ram speed of the press forge was 1 inch/second, which corresponded to a strain rate of 0.27 $s^{-1}$. The adiabatically heated center of the workpiece and the flame heated surface region of the workpiece were allowed to equilibrate to the workpiece forging temperature for about 4.8 minutes. The workpiece was rotated and press forged in the direction of the C axis of the workpiece to a spacer height of 4 inches. The ram speed of the press forge was 1 inch/second, which corresponded to a strain rate of 0.27 $s^{-1}$. The adiabatically heated center of the workpiece and the flame heated surface region of the workpiece were allowed to equilibrate to the workpiece forging temperature for about 4.8 minutes. The a-b-c (multi-axis) forging described above was repeated four times for a total of 12 forge hits, producing a true strain of 4.7. After multi-axis forging, the workpiece was water quenched. The thermomechanical processing path for Example 1 is shown in FIG. 9.

Example 2

Figure 10:
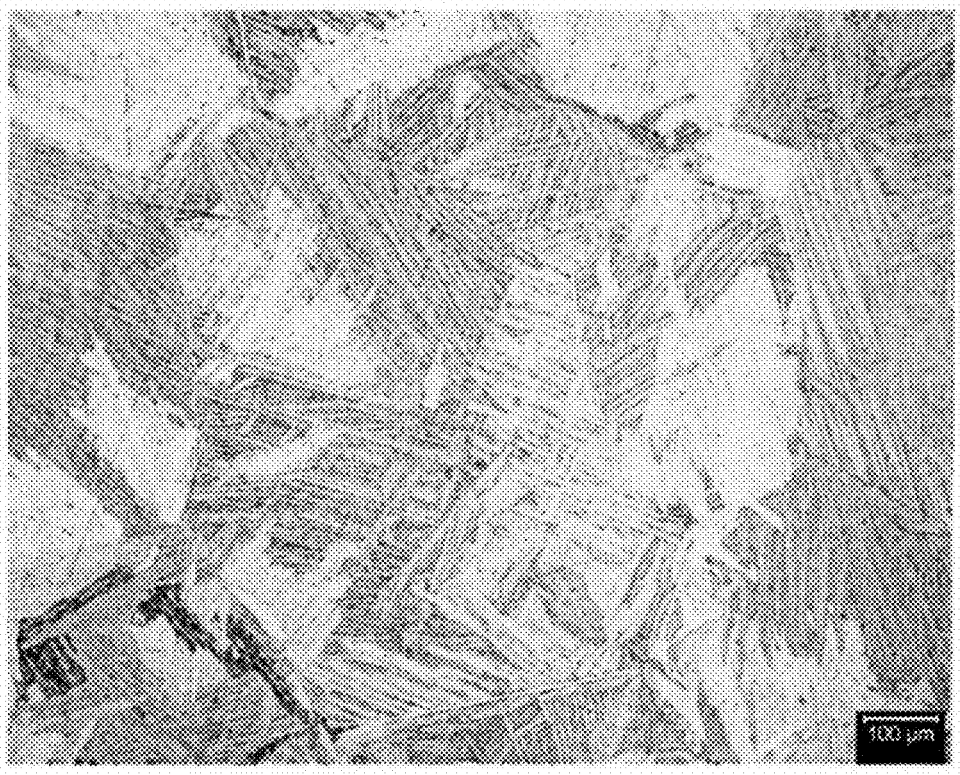
FIG. 10 is a micrograph of the beta annealed material of Example 1 showing equiaxed grains with grain sizes between 10-30 μm.
Figure 11:
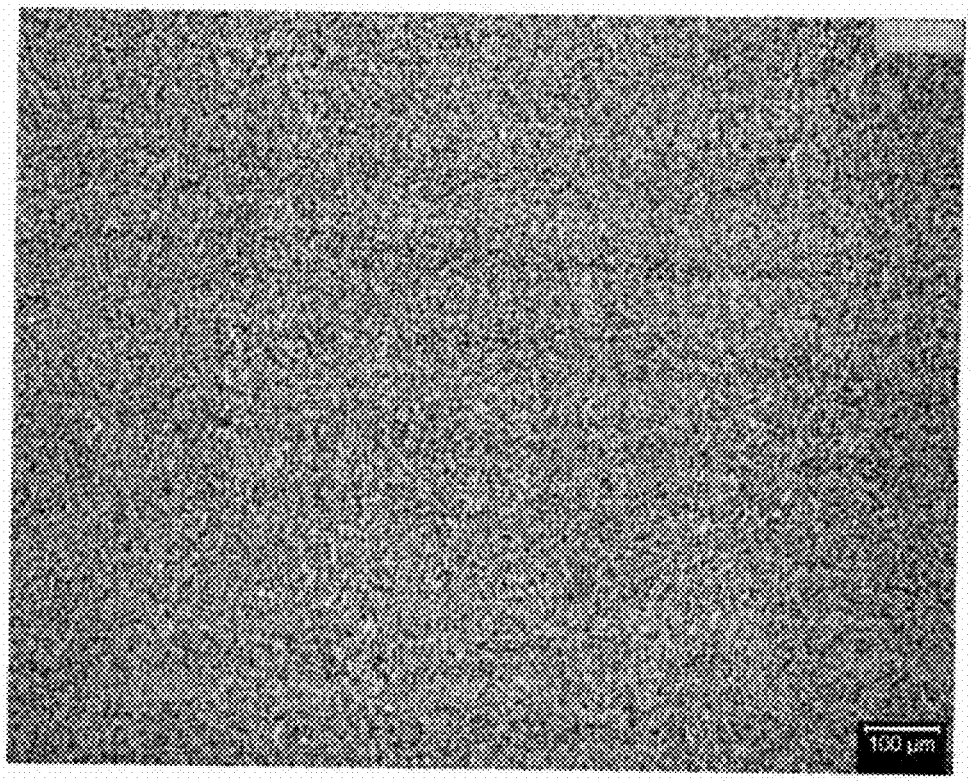
FIG. 11 is a micrograph of a center region of the a-b-c forged sample of Example 1.
Figure 12:
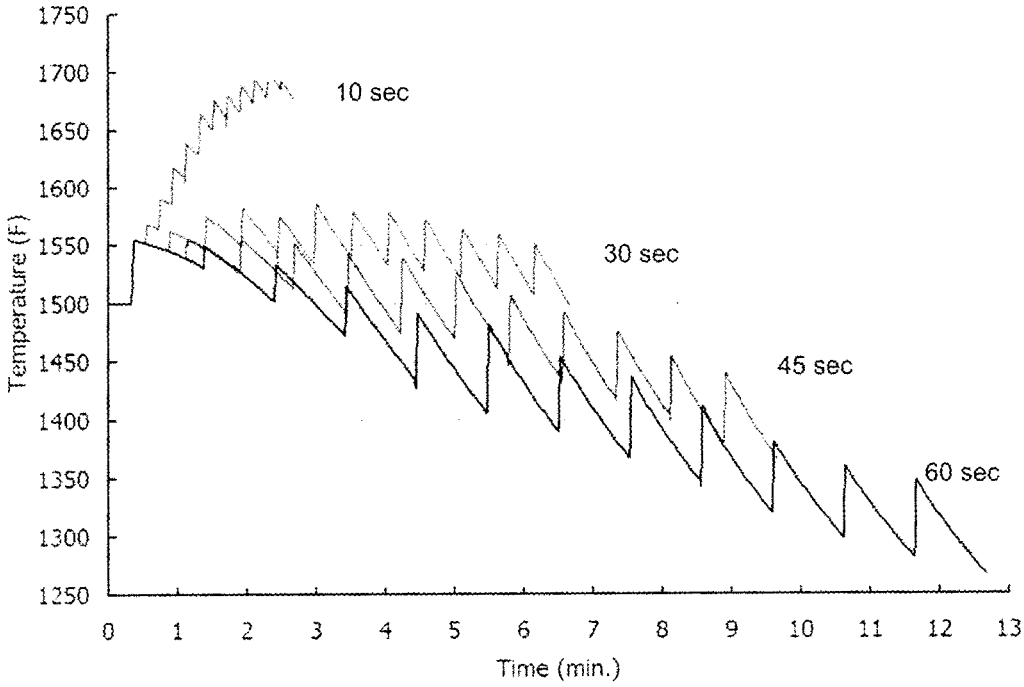
FIG. 12 a finite element modeling prediction of internal region cooling times according to a non-limiting embodiment of this disclosure.

A sample of the starting material of Example 1 and a sample of the material as processed in Example 1 were metallographically prepared and the grain structures were microscopically observed. FIG. 10 is a micrograph of the beta annealed material of Example 1 showing equiaxed grains with grain sizes between 10-30 μm. FIG. 11 is a micrograph of a center region of the a-b-c forged sample of Example 1. The grain structure of FIG. 11 has equiaxed grain sizes on the order of 4 μm and would qualify as "very fine grain" (VFG) material. In the sample, the VFG sized grains were observed predominantly in the center of the sample. Grain sizes in the sample were larger as the distance from the center of the sample increased.

Example 3

Finite element modeling was used to determine internal region cooling times required to cool the adiabatically heated internal region to a workpiece forging temperature. In the modeling, a 5 inch diameter by 7 inch long alpha-beta titanium alloy preform was virtually heated to a multi-axis forging temperature of 1500° F. (815.6° C.). The forging dies were simulated to be heated to 600° F. (315.6° C.). A ram speed was simulated at 1 inch/second, which corresponds to a strain rate 0.27 $s^{-1}$. Different intervals for the internal region cooling times were input to determine an internal region cooling time required to cool the adiabatically heated internal region of the simulated workpiece to the workpiece forging temperature. From the plot of FIG. 10, it is seen that the modeling suggests that internal region cooling times of between 30 and 45 seconds could be used to cool the adiabatically heated internal region to a workpiece forging temperature of about 1500° F. (815.6° C.).

Example 4

High strain rate multi-axis forging using a thermal management system was performed on a titanium alloy workpiece consisting of a 4 inch (10.16 cm) sided cube of alloy Ti-6-4. The titanium alloy workpiece was beta annealed at 1940° F. (1060° C.) for 60 minutes. After beta annealing, the workpiece was air cooled to room temperature. The titanium alloy workpiece was heated to a workpiece forging temperature of 1500° F. (815.6° C.), which is in the alpha-beta phase field of the titanium alloy workpiece. The workpiece was multi-axis forged using a thermal management system comprising gas flame heaters and heated dies according to non-limiting embodiments of this disclosure to equilibrate the temperature of the external surface region of the workpiece to the workpiece forging temperature between the hits of multi-axis forging. The workpiece was press forged to 3.2 inches (8.13 cm). Using a-b-c rotation, the workpiece was subsequently press forged in each hit to 4 inches (10.16 cm). A ram speed of 1 inch per second (2.54 cm/s) was used in the press forging steps, and a pause, i.e., an internal region cooling time or equilibration time of 15 seconds was used between press forging hits. The equilibration time is the time that is allowed for the adiabatically heated internal region to cool to the workpiece forging temperature while heating the external surface region to the workpiece forging temperature. A total of 12 hits were used at the 1500° F. (815.6° C.) workpiece temperature, with a 90° rotation of the cubic workpiece between hits, i.e., the cubic workpiece was a-b-c forged four times.

The temperature of the workpiece was then lowered to a second workpiece forging temperature of 1300° F. (704.4° C.). The titanium alloy workpiece was high strain multi-axis forged according to non-limiting embodiments of this disclosure, using a ram speed of 1 inch per second (2.54 cm/s) and internal region cooling times of 15 seconds between each forging hit. The same thermal management system used to manage the first workpiece forging temperature was used to manage the second workpiece forging temperature. A total of 6 forging hits were applied at the second workpiece forging temperature, i.e., the cubic workpiece was a-b-c forged two times at the second workpiece forging temperature.

Example 5

Figure 13:
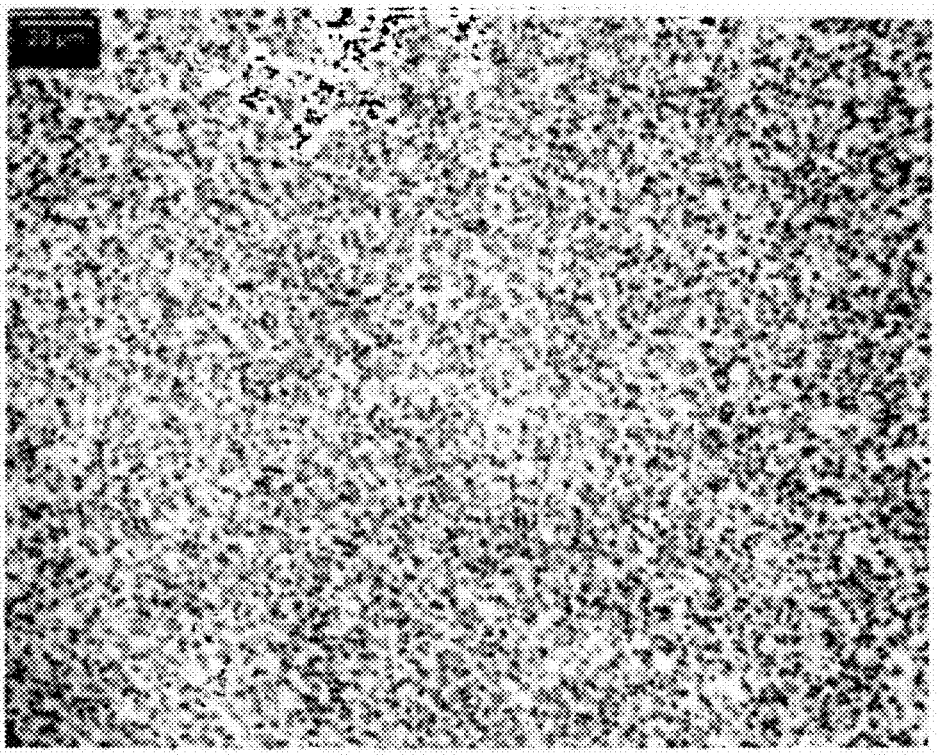
FIG. 13 is a micrograph of the center of a cube after processing according to the embodiment of the non-limiting method described in Example 4.

A micrograph of the center of the cube after processing as described in Example 4 is shown in FIG. 13. From FIG. 13, it is observed that the grains at the center of the cube have an equiaxed average grain size of less than 3 μm, i.e., an ultrafine grain size.

Figure 14:
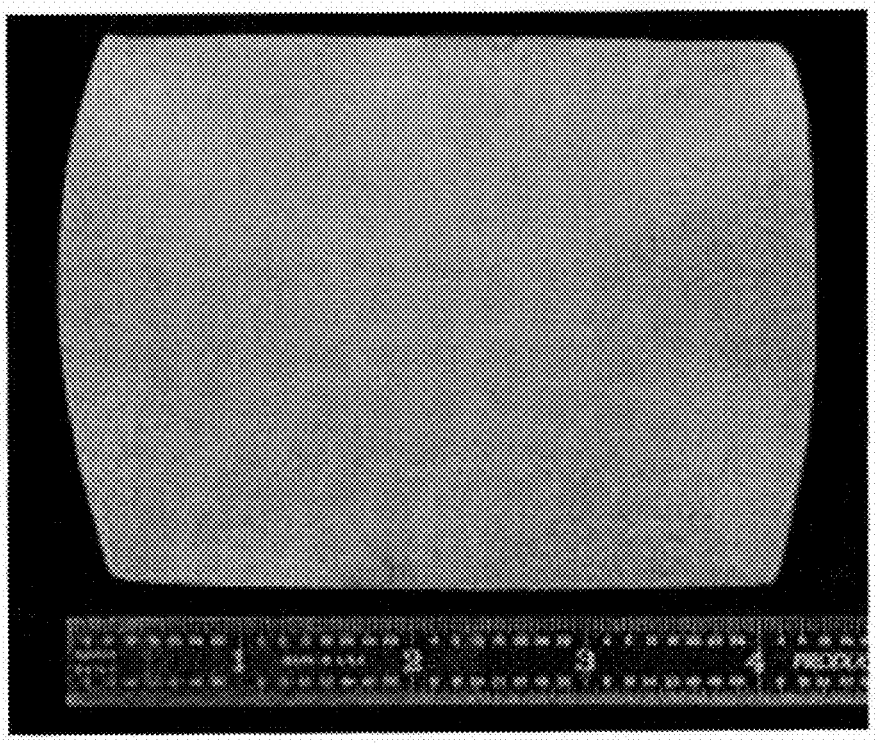
FIG. 14 is a photograph of a cross-section of a cube processed according to Example 4.

Although the center or internal region of the cube processed according to Example 4 had an ultrafine grain size, it was also observed that the grains in regions of the processed cube external to the center region were not ultrafine grains. This is evident from FIG. 14, which is a photograph of a cross-section of the cube processed according to Example 4.

Example 6

Figure 15:
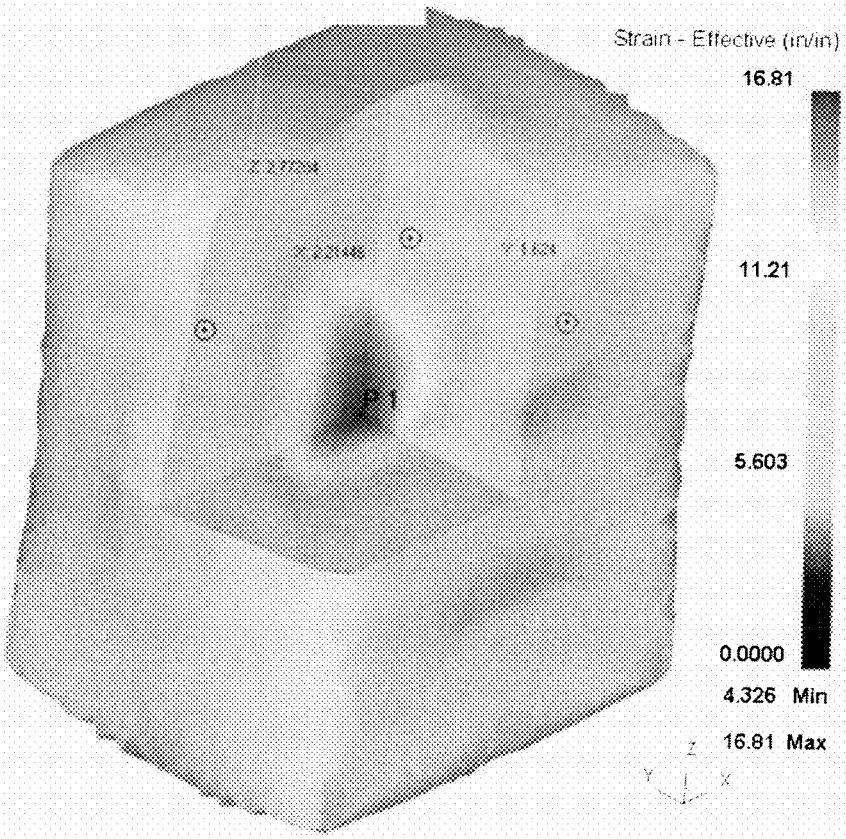
FIG. 15 represents the results of finite element modeling to simulate deformation in thermally managed multi-axis forging of a cube processed according to Example 6.

Finite element modeling was used to simulate deformation in thermally managed multi-axis forging of a cube. The simulation was carried out for a 4 inch sided cube of Ti-6-4 alloy that was beta annealed at 1940° F. (1060° C.) until an all beta microstructure is obtained. The simulation used isothermal multi-axis forging, as used in certain non-limiting embodiments of a method disclosed herein, conducted at 1500° F. (815.6° C.). The workpiece was a-b-c press forged with twelve total hits, i.e., four sets of a-b-c orthogonal axis forgings/rotations. In the simulation, the cube was cooled to 1300° F. (704.4° C.) and high strain rate press forged for 6 hits, i.e., two sets of a-b-c orthogonal axis forgings/rotations. The simulated ram speed was 1 inch per second (2.54 cm/s). The results shown in FIG. 15 predict levels of strain in the cube after processing as described above. The finite element modeling simulation predicts a maximum strain of 16.8 at the center of the cube. The highest strain, however, is very localized, and the majority of the cross-section does not achieve a strain greater than 10.

Example 7

A workpiece comprising alloy Ti-6-4 in the configuration of a five-inch diameter cylinder that is 7 inches high (i.e., measured along the longitudinal axis) was beta annealed at 1940° F. (1060° C.) for 60 minutes. The beta annealed cylinder was air quenched to preserve the all beta microstructure. The beta annealed cylinder was heated to a workpiece forging temperature of 1500° F. (815.6° C.) and was followed by multiple upset and draw forging according to non-limiting embodiments of this disclosure. The multiple upset and draw sequence included upset forging to a 5.25 inch height (i.e., reduced in dimension along the longitudinal axis), and multiple draw forging, including incremental rotations of 45° about the longitudinal axis and draw forging to form an octagonal cylinder having a starting and finishing circumscribed circle diameter of 4.75 inches. A total of 36 draw forgings with incremental rotations were used, with no wait times between hits.

Example 8

Figure 16A:
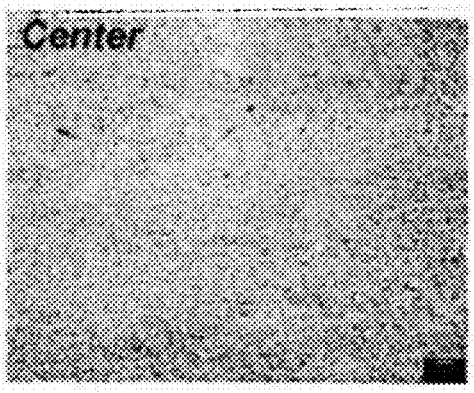
FIG. 16(*a*) is a micrograph of a cross-section from the center of the sample processed according to Example 7.
Figure 16B:
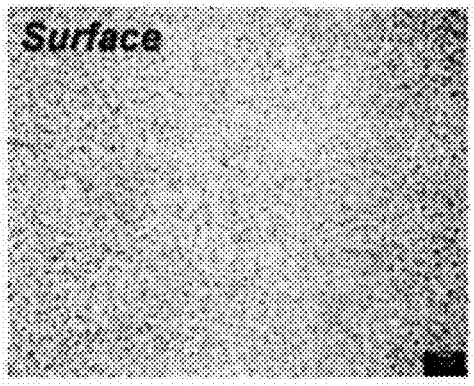

A micrograph of a center region of a cross-section of the sample prepared in Example 7 is presented in FIG. 16(*a*). A micrograph of the near surface region of a cross-section of the sample prepared in Example 7 is presented in FIG. 16(*b*). Examination of FIGS. 16(*a*) and (*b*) reveals that the sample processed according to Example 7 achieved a uniform and equiaxed grain structure having an average grain size of less than 3 μm, which is classified as very fine grain (VFG).

Example 9

Figure 17:
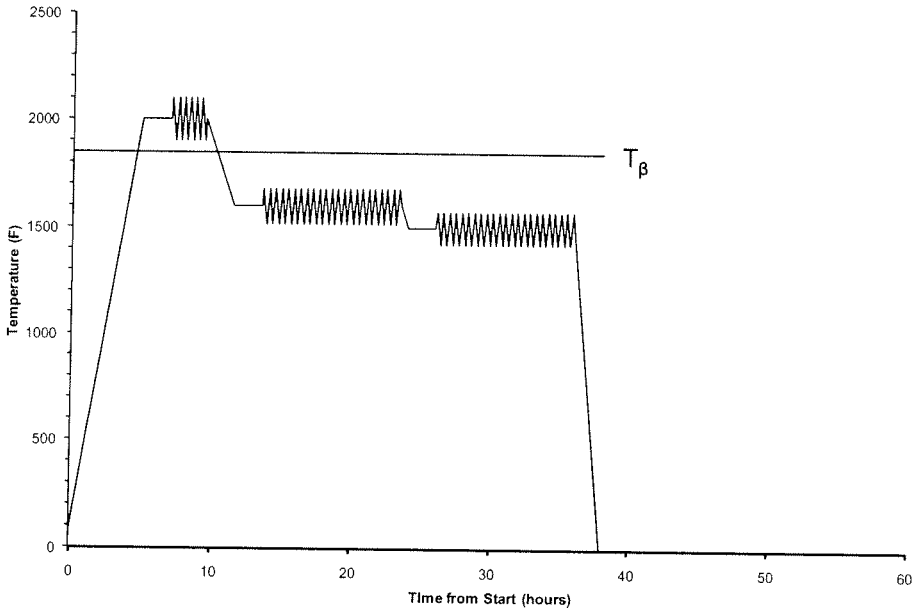
FIG. 17 is a schematic thermomechanical temperature-time chart of the process used in Example 9.

A workpiece comprising alloy Ti-6-4 configured as a ten-inch diameter cylindrical billet having a length of 24 inches was coated with silica glass slurry lubricant. The billet was beta annealed at 1940° C. The beta annealed billet was upset forged from 24 inches to a 30-35% reduction in length. After beta upsetting, the billet was subjected to multiple pass draw forging, which comprised incrementally rotating and draw forging the billet to a ten-inch octagonal cylinder. The beta processed octagonal cylinder was air cooled to room temperature. For the multiple upset and draw process, the octagonal cylinder was heated to a first workpiece forging temperature of 1600° F. (871.1° C.). The octagonal cylinder was upset forged to a 20-30% reduction in length, and then multiple draw forged, which included rotating the working by 45° increments followed by draw forging, until the octagonal cylinder achieved its starting cross-sectional dimension. Upset forging and multiple pass draw forging at the first workpiece forging temperature was repeated three times, and the workpiece was reheated as needed to bring the workpiece temperature back to the workpiece forging temperature. The workpiece was cooled to a second workpiece forging temperature of 1500° F. (815.6° C.). The multiple upset and draw forging procedure used at the first workpiece forging temperature was repeated at the second workpiece forging temperature. A schematic thermomechanical temperature-time chart for the sequence of steps in this Example 9 is presented in FIG. 17.

The workpiece was multiple pass draw forged at a temperature in the alpha+beta phase field using conventional forging parameters and cut in half for upset. The workpiece was upset forged at a temperature in the alpha+beta phase field using conventional forging parameters to a 20% reduction in length. In a finishing step, the workpiece was draw forged to a 5 inch diameter round cylinder having a length of 36 inches.

Example 10

Figure 18:
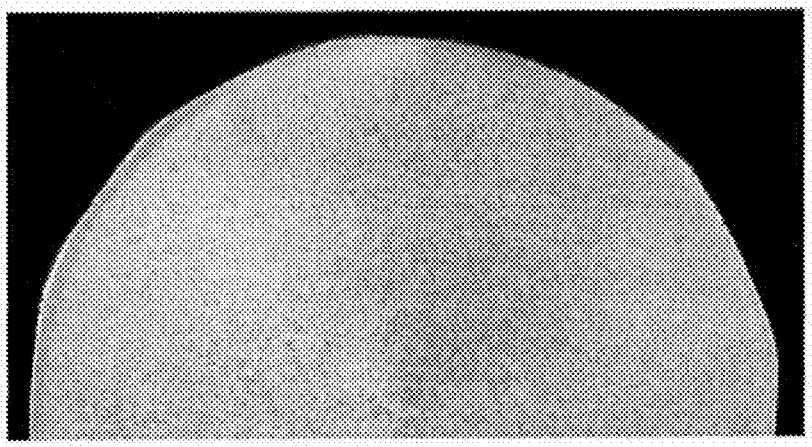
FIG. 18 is a macro-photograph of a cross-section of a sample processed according to the non-limiting embodiment of Example 9.
Figure 19:
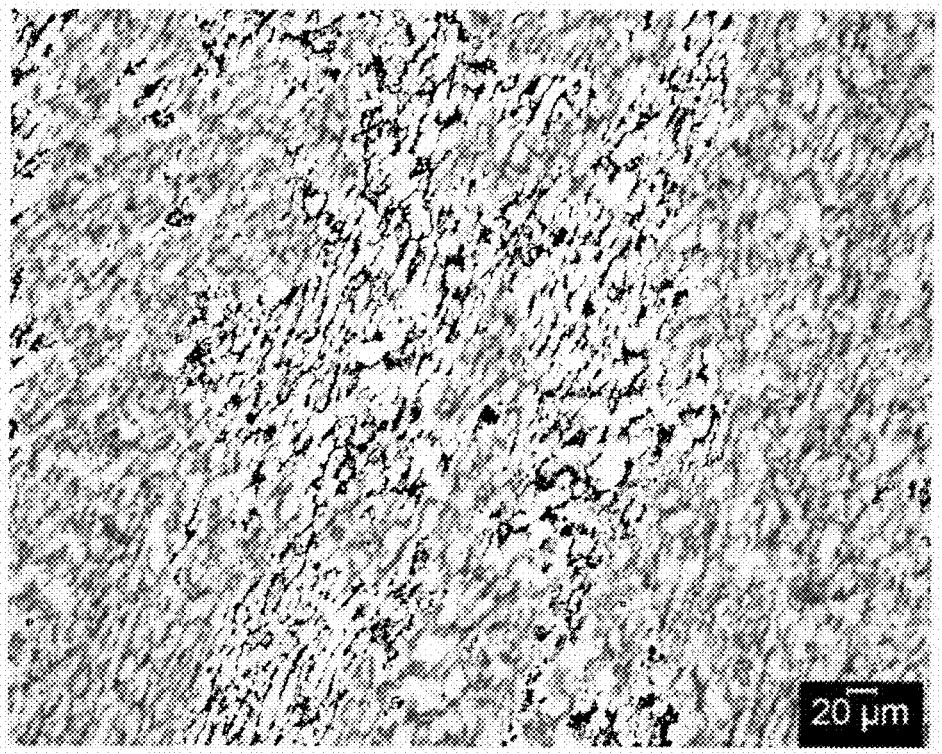
FIG. 19 is a micrograph of a sample processed according to the non-limiting embodiment of Example 9 showing the very fine grain size.

A macro-photograph of a cross-section of a sample processed according to the non-limiting embodiment of Example 9 is presented in FIG. 18. It is seen that a uniform grain size is present throughout the billet. A micrograph of the sample processed according to the non-limiting embodiment of Example 9 is presented in FIG. 19. The micrograph demonstrates that the grain size is in the very fine grain size range.

Example 11

Figure 20:
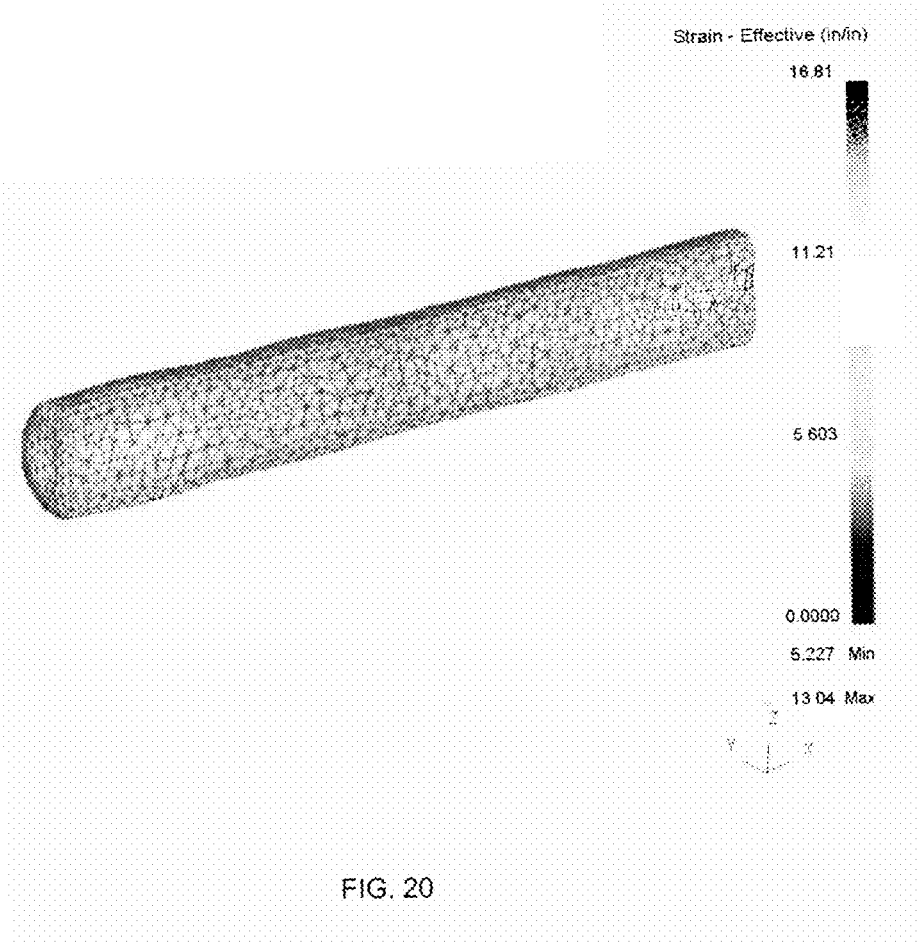
FIG. 20 represents a finite element modeling simulation of deformation of the sample prepared in the non-limiting embodiment of Example 9.

Finite element modeling was used to simulate deformation of the sample prepared in Example 9. The finite element model is presented in FIG. 20. The finite element model predicts relatively uniform effective strain of greater than 10 for the majority of the 5-inch round billet.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. A method of refining a grain size of a workpiece comprising a metallic material selected from titanium and a titanium alloy, the method comprising:

heating the workpiece to a workpiece forging temperature within an alpha+beta phase field of the metallic material; and multi-axis forging the workpiece, wherein multi-axis forging comprises press forging the workpiece at the workpiece forging temperature in the direction of a first orthogonal axis of the workpiece with a strain rate sufficient to adiabatically heat an internal region of the workpiece, allowing the adiabatically heated internal region of the workpiece to cool to the workpiece forging temperature, while heating an outer surface region of the workpiece to the workpiece forging temperature, press forging the workpiece at the workpiece forging temperature in the direction of a second orthogonal axis of the workpiece with a strain rate that is sufficient to adiabatically heat the internal region of the workpiece, allowing the adiabatically heated internal region of the workpiece to cool to the workpiece forging temperature, while heating the outer surface region of the workpiece to the workpiece forging temperature, press forging the workpiece at the workpiece forging temperature in the direction of a third orthogonal axis of the workpiece with a strain rate that is sufficient to adiabatically heat the internal region of the workpiece, allowing the adiabatically heated internal region of the workpiece to cool to the workpiece forging temperature, while heating the outer surface region of the workpiece to the workpiece forging temperature, and repeating at least one of the preceding press forging and the allowing steps until a true strain of at least 3.5 is achieved in at least a region of the workpiece.

2. The method of claim 1, wherein a strain rate used during press forging is in the range of 0.2 $s^{-1}$ to 0.8 $s^{-1}$.

3. The method of claim 1, wherein the workpiece comprises a titanium alloy selected from the group consisting of an alpha titanium alloy, an alpha+beta titanium alloy, a metastable beta titanium alloy, and a beta titanium alloy.

4. The method of claim 1, wherein the workpiece comprises an alpha+beta titanium alloy.

5. The method of claim 1, wherein the workpiece comprises a titanium alloy selected from ASTM Grade 5, 6, 12, 19, 20, 21, 23, 24, 25, 29, 32, 35, 36, and 38 titanium alloys.

6. The method of claim 1, wherein heating a workpiece to a workpiece forging temperature within an alpha+beta phase field of the metallic material comprises:

heating the workpiece to a beta soaking temperature of the metallic material;

holding the workpiece at the beta soaking temperature for a beta soaking time sufficient to form a 100% beta phase microstructure in the workpiece; and cooling the workpiece to the workpiece forging temperature.

7. The method of claim 6, wherein the beta soaking temperature is in a temperature range of the beta transus temperature of the metallic material up to 300° F. (111° C.) above the beta transus temperature of the metallic material, inclusive.

8. The method of claim 6, wherein the beta soaking time is from 5 minutes to 24 hours.

9. The method of claim 6, further comprising plastically deforming the workpiece at a plastic deformation temperature in the beta phase field of the metallic material prior to cooling the workpiece to the workpiece forging temperature.

10. The method of claim 9, wherein plastically deforming the workpiece at a plastic deformation temperature in the beta phase field of the metallic material comprises at least one of drawing, upset forging, and high strain rate multi-axis forging the workpiece.

11. The method of claim 9, wherein the plastic deformation temperature is in a plastic deformation temperature range of the beta transus temperature of the metallic material up to 300° F. (111° C.) above the beta transus temperature of the metallic material, inclusive.

12. The method of claim 9, wherein plastically deforming the workpiece comprises high strain rate multi-axis forging, and wherein cooling the workpiece to the workpiece forging temperature further comprises high strain rate multi-axis forging the workpiece as the workpiece cools to the workpiece forging temperature in the alpha+beta phase field of the metallic material.

13. The method of claim 9, wherein plastically deforming the workpiece comprises upset forging the workpiece to a beta-upset strain in the range of 0.1 to 0.5, inclusive.

14. The method of claim 1, wherein the workpiece forging temperature is in a temperature range of 100° F. (55.6° C.) below the beta transus temperature of the metallic material to 700° F. (388.9° C.) below the beta transus temperature of the metallic material.

15. The method of claim 1, wherein the adiabatically heated internal region of the workpiece is allowed to cool for an internal region cooling time in the range of 5 seconds to 120 seconds, inclusive.

16. The method of claim 1, further comprising repeating one or more steps of the press forging and allowing steps recited in claim 1 until a true strain of 4.7 is achieved in the workpiece.

17. The method of claim 1, wherein heating the outer surface of the workpiece comprises heating using one or more of flame heating, box furnace heating, induction heating, and radiant heating.

18. The method of claim 1, further comprising heating a die of a forge used to press forge the workpiece to a temperature in a temperature range of the workpiece forging temperature to 100° F. (55.6° C.) below the workpiece forging temperature, inclusive.

19. The method of claim 1, wherein repeating comprises repeating the press forging and allowing steps recited in claim 1 at least 4 times.

20. The method of claim 1, wherein after a true strain of 3.7 is achieved, the workpiece comprises an average alpha particle grain size in the range of 4 μm to 6 μm, inclusive.

21. The method of claim 1, wherein after a true strain of 4.7 is achieved, the workpiece comprises an average alpha particle grain size of 4 μm.

22. The method of any of claims 20 and 21, wherein on completion of the method the alpha particle grains are equiaxed.

23. The method of claim 1, further comprising:

cooling the workpiece to a second workpiece forging temperature in the alpha+beta phase field of the metallic material;

press forging the workpiece at the second workpiece forging temperature in the direction of a first orthogonal axis of the workpiece with a strain rate sufficient to adiabatically heat the internal region of the workpiece;

allowing the adiabatically heated internal region of the workpiece to cool to the second workpiece forging temperature, while heating the outer surface region of the workpiece to the second workpiece forging temperature;

press forging the workpiece at the second workpiece forging temperature in the direction of a second orthogonal axis of the workpiece with a strain rate that is sufficient to adiabatically heat the internal region of workpiece;

allowing the adiabatically heated internal region of the workpiece to cool to the second workpiece forging temperature, while heating the outer surface region of the workpiece to the second workpiece forging temperature;

press forging the workpiece at the second workpiece forging temperature in the direction of a third orthogonal axis of the workpiece with a strain rate that is sufficient to adiabatically heat the internal region of the workpiece;

allowing the adiabatically heated internal region of the workpiece to cool to the second workpiece forging temperature, while heating an outer surface region of the workpiece to the second workpiece forging temperature; and repeating one or more of the preceding press forging and allowing steps until a true strain of at least 10 is achieved in at least a region of the workpiece.

24. The method of claim 1, wherein the workpiece comprises a metastable beta titanium alloy.

25. The method of claim 1, wherein a strain rate used during press forging is at least 0.2 $s^{-1}$.

* * * * *